US006587745B1

(12) United States Patent
Polden et al.

(10) Patent No.: US 6,587,745 B1
(45) Date of Patent: Jul. 1, 2003

(54) CURVED LINE FILL STITCHING IN EMBROIDERY DESIGNS

(75) Inventors: Alexander Polden, Alexandria (AU); William Brian Wilson, Alexandria (AU)

(73) Assignee: Wilcom Pty Ltd (AU)

( * ) Notice: Subject to any disclaimer, the term of this patent is extended or adjusted under 35 U.S.C. 154(b) by 0 days.

(21) Appl. No.: 09/786,799

(22) PCT Filed: Sep. 7, 1999

(86) PCT No.: PCT/AU99/00739

§ 371 (c)(1),
(2), (4) Date: Jun. 15, 2001

(87) PCT Pub. No.: WO00/14319

PCT Pub. Date: Mar. 16, 2000

(30) Foreign Application Priority Data

Sep. 7, 1998 (AU) ..... PP 5766

(51) Int. Cl.[7] ..... D05C 5/02; G06F 19/00
(52) U.S. Cl. ..... 700/138; 112/475.19
(58) Field of Search ..... 700/138, 136, 700/137; 112/475.19, 102.5, 470.06

(56) References Cited

U.S. PATENT DOCUMENTS 4,915,041 A 4/1990 Takenoya
5,255,198 A 10/1993 Yokoe et al.
5,261,341 A 11/1993 Asano
6,356,648 B1 * 3/2002 Taguchi ..... 700/138 X
6,390,005 B1 * 5/2002 Chia et al. ..... 112/475.19

OTHER PUBLICATIONS

Schneider, C. (1978). *Embroidery: Shiffli & Multihead.* McCart, M. ed., International Standard Book No. 0–9601662–1–1, pp. vii–viii. (Table of Contents only).

* cited by examiner

*Primary Examiner*—Peter Nerbun
(74) *Attorney, Agent, or Firm*—Morrison & Foerster LLP

(57) ABSTRACT

This invention concerns automatically generating embroidery stitch patterns in a computer aided design system where areas defined by vector outline shapes are filled with stitches which follow curved lines rather than straight lines. This is done in a way to maintain consistent densities and consistent needle penetration patterns inside the areas. The shapes of the areas may be simple polygons which can be filled in one contiguous segment of curved stitching, or they may be complex or multi-boundary shapes which must be stitched in more than one distinct segments of curved line stitching. The areas are transformed into another coordinate space where known calculation methods for straight line stitching are used to calculate straight line fills of the transformed area. The resulting area and stitches are then transformed back to the original coordinates, resulting in even stitching along smooth curves which fills the original area such that the intermediate stitch penetration points along the curves form a smooth continuous visual pattern throughout the area.

53 Claims, 18 Drawing Sheets

CURVED LINE FILL STITCHING IN EMBROIDERY DESIGNS

FIELD OF THE INVENTION

The present invention relates generally to the generation of an embroidery design in a computer aided design system. Such designs involve stitching instructions that are used by automatic embroidery machines to embroider designs. In particular the invention concerns a method for generating an embroidery designs. In a second aspect the invention is a system for generating an embroidery design. In a third aspect the invention is a series of stitch commands for controlling an automatic embroidery machine so that it is able to perform the method.

DESCRIPTION OF PRIOR ART

Automatic embroidery machines are very well known in the embroidery industry. The primary characteristics of automatic embroidery machines, and the basic manner in which embroidery designs are defined for these prior art machines is described in the book. "Embroidery: Schiffli & Multihead", by Coleman Schneider, 1978. International Standard Book Number 0-9601662-1-1.

An automatic embroidery machine typically operates by moving a piece of fabric or garment to be embroidered in the X and Y directions, defined according to a standard XY Cartesian coordinate system, under an embroidery needle. As the fabric is moved, the needle reciprocates up and down to penetrate the fabric at pre-defined XY locations on the fabric, forming stitches of thread in a sequence to form the embroidery design. To embroider a particular design, an automatic embroidery machine is given a series of stitch commands that define the sequence of XY movements required to form that design. The series of stitch commands used by automatic embroidery machines are generally referred to as "stitch data format", since every individual stitch location is explicitly defined.

There are many commercial systems on the market in widespread use for creating and modifying stitch designs for use by automatic embroidery machines. These "Design Systems" are typically referred to in industry as embroidery CAD (Computer Aided Design) systems "Punching Systems" or "Digitizing Systems". Embroidery Design Systems in common use, typically output designs in "Stitch Data Format" for use on automatic embroidery machines. Most commercial Design Systems also work with "Outline Data Format", also known as "Condensed Data Format". This refers to a means of defining an embroidery design in terms of a sequence of geometric shapes to be filled with stitches, where for each shape, the stitching parameters required to calculate stitches of the desired stitch type are defined and stored with the shapes. The geometric shapes are typically defined in the form of geometric polygons, formed by straight line segments, curved line segments, or a mixture. Various forms of mathematical curves are used in industry to define shapes to be stitched, including Bezier curves, various types of spline curves, circular arcs, and the like. The stitching parameters stored with the shapes include the "stitch type", the stitching calculation method to use, the stitch density or spacing, the stitch lengths, and so on. There are many different methods to fill a shape with stitches, and each has its own specific set of parameters.

In the drawings that follow, a convention has been adopted to represent needle penetration points as dots 1, and stitches as straight lines 2 that interconnect the dots.

Areas which are parts of embroidery designs are typically defined as geometric outlines 3, as shown for example in FIG. 1*a*. Prior art embroidery design systems already have well known and well refined methods whereby areas to be filled with stitches can be described graphically by operators, or from pre-defined artwork such as clipart. There are existing methods for calculating curves and straight lines for these shapes, displaying them graphically or numerically, editing the shape of the areas, calculating the various stitch types, and displaying stitches and areas together or separately.

Areas are sometimes stitched "along the outline of their shape", as in the case of "running stitch" shown in FIG. 1*b*. In other cases, areas are "filled" with stitches "inside" the outlines of a closed shape or polygon. If the area is small enough (typically less than 127 mm across), it is typically filled with a back and forth motion across the shapes with a single stitch, referred to as "satin stitch" as shown in FIG. 1*c*: note the alternate vertical and sloping stitches.

When the areas are larger, such that it is not possible or practical for a single stitch movement to cover the distance from one side of the area to the other, or when certain artistic effects are desired inside the area, various techniques are used to calculate multiple intermediate stitch points, across the area. The most common method of this is referred to as 'tatami' stitching, or "geflecht", or "step stitch" and this is illustrated in FIG. 1*d*. Using this technique, the intermediate stitch points going across an area are carefully calculated relative to each other so that the needle points are staggered, or offset from those on adjacent lines of stitching going across the area, to minimize the visibility of the intermediate stitch points. In this case the stitch points extend in diagonals, indicated at 4, across the lines of stitches.

Another common practice is to have the intermediate stitch points form desired visible shapes or patterns inside the area, usually for artistic reasons, see for example FIG. 1*e*. This example shows stitch points arranged in circular patterns 5 which are repeated across the area. The intermediate needle penetrations across the area form very visible lines, because the penetrations on adjacent lines of stitching are close together. This effect is often referred to in industry as "program split" stitch type.

The pattern of intermediate needle penetrations in the finished embroidery is visible to the human eye in all cases, whether it is the designers intention to minimize their visibility, or to maximize the visibility. Therefore it is important to calculate the intermediate points so that there are no visual discontinuities in the visual patterns created by the intermediate stitch points.

As seen in FIGS. 1*c*, 1*d* and 1*e*, it is common practice is to fill areas with stitches with straight stitch lines which are parallel to each other. The lines may be vertical, but other angles are also used. For instance, the areas may be filled with straight lines of stitches where the angle of the straight lines varies smoothly across the area so that they fan out as shown in FIG. 1*f*.

In all of the "fill" examples given above, the basic method of filling is to calculate a series of straight lines which go back and forth across the area, and then use these straight lines as either individual stitches (eg satin stitch), or to calculate intermediate stitch points along these straight lines. In all cases, careful control of the placement of the stitch lines is needed to ensure consistent density of stitch lines in the shape, and consistent visual effect of the intermediate stitches.

A typical complication for filling areas with straight line fills is illustrated in FIG. 1*g* and in FIG. 2. In this situation, the area has an internal and external boundary, and it is required to fill the area between the two boundaries, leaving the "hole" 6 unstitched. The technique for doing this is referred to in the industry as "Complex Fill". It is characterized by the fact that the straight stitch lines which cross the area intersect the boundary more than twice in some places (eg when thee cross the hole).

The automatic filling method for Complex Fill will be described with reference to FIG. 2. The complex shaped area 10 has a diamond shaped hole 11 in it. The shape 10 is complex because it is not possible to fill it with an uninterrudted series of straight lines of stitching. The method breaks the whole area 10 into sub-areas which are bounded by the intersection of stitch lines with the holes or with the outside boundaries. The horizontal lines 12, 13 and 14 indicate the boundaries between different sub-areas 15, 16, 17, 18, 19 and 20 of the complex fill, as shown in FIG. 2*a*. Then it is necessary to calculate stitching for each sub-area, and sequence the sub-areas carefully. When travelling between the sub-areas, or segments, it is necessary to ensure they all join together properly. If intermediate stitch points are required along the straight lines, these must be calculated so that the visual pattern created by the intermediate stitch points is consistent across the entire area. That is, the pattern of needle penetrations inside the area must match between sub-areas, so no discontinuities are visible. If not, the visual artistic effect of the embroidery stitching is poor and customers would reject the design. FIG. 2*b* shows the area after it has been filled, and FIG. 2*c* shows the area partly filled, in this condition sub-areas 15, 16, 17 and 19 have been filled.

Embroidery designers often would like to fill some areas with curved lines of stitching instead of straight lines of stitching. Curved lines of stitching can give very good, artistic effects to the look of the embroidery, creating a 3-dimensional like effect, or giving a more life-like feel to the embroidery, for example, when stitching an area which represents a real 3-dimensional object. However, while existing embroidery design systems can calculate stitching along individual curved lines, that is outlines, quite well, they cannot do a good job in automatically filling areas with a series of automatically calculated curved lines. As a result embroidery designers can't use curved lines to fill in areas very much.

Some known systems have a simple capability of curved stitching, often referred to as "contour stitching" or "piping", or the like. But this technique has several very serious limitations, which restricts its use to a small number of special cases.

A example of this prior art "contour stitching" is shown in FIG. 1*h*. In Contour stitching the stitching does not jump back and forth across the "width" of the area with straight lines, but rather follows the edge or contour of the shape along the "length" of the shape. The number of contour lines to fill the area is determined typically by dividing the widest part of the area by the user specified density or stitch spacing (distance between adjacent stitch lines). There are many limitations to this type of stitching: The stitch density between adjacent lines of stitching varies greatly across the shape because the same number of stitch lines are used in wide areas and narrow areas. Variations of +/−10% are generally acceptable, but greater variations are not normally acceptable. The narrow parts have too many stitches, see the narrow end 7, which cause thread breaks and production problems, it takes much longer to stitch because of the additional stitches and the look of the finished embroidery is uneven. The visual pattern of intermediate stitch points often has noticeable discontinuities 8 in it resulting in an uneven visual effect, and is seen as undesirable, poor quality embroider. Because the lines are not straight in Contour stitching, the placement of the intermediate stitch points along a line are determined largely by the shape of the area being filled.

Another common practice is to fill areas with lines of small repeating sequences of stitches called motifs, see 9 in FIG. 1*i*. This is known as "motif fill". Note that the diamonds are arranged in straight lines and form a regular pattern across the shape.

Using contour stitching, it is not possible to use stitch techniques such as "program split" or "motif fill" inside the shape, and it is not possible to have holes without stitching inside the filled shape.

Embroidery design systems have had the capability to perform automatic "complex fill" with straight line stitching techniques as early as 1989. and have been able to perform "contour type" curved stitching for about as long, but it has not heretofore been possible to have curved line stitching which satisfies the conflicting requirements of consistent density, consistent visual effect of intermediate stitch points, and curved stitching lines independent of the shape to be filled.

SUMMARY OF THE INVENTION

In a first aspect, the invention is a method for generating an embroidery design in a computer aided design system, including the following steps:

(a) specifying an area in the design to be filled with stitching;

(b) specifying a stitch type of embroidery fill stitch to fill the area;

(c) specifying a stitch definition curve;

(d) calculating the positions of stitch points to fill the area, such that the stitch points extend along "lines of fill", each of which in order of stitching has a first edge point at one edge of the area, a series of intermediate stitch points and a second edge point at another edge of the area, and such that the intermediate stitch points extend across the lines of fill to form "lines of patterns" made up of either individual stitch points or groups of stitch points according to the characteristics of the stitch type, and where the lines of fill and the lines of patterns are curved in dependence upon the stitch definition curve but not on the shape of the area to be filled: and (e) recording the positions of the stitch points which extend throughout the area.

The phrase "lines of fill" has been used to describe a series of stitch points which define a line of stitching extending across the area. The line of stitching may be a single row of stitch points, or a line of motifs.

The phrase "lines of patterns" refers to the lines of patterns visible in the embroidery, which extend across the lines of fill. The patterns may be made by the staggering, or offsetting, of single stitch points in adjacent lines, or by staggering more complicated groups of stitch points as in "program split".

In this way an embroidery stitch pattern may be generated in which a selected shape, that is the shape of the area, may be filled with stitches which follow continuous curved lines which may be independent of the shape being filled, the visual effects across the lines of stitching may be continuous, and the stitch density may be maintained consistently throughout the shape within acceptable embroidery tolerances.

The outline of the shape in the pattern may be freely specified within the imagination of the user of the method. Alternatively, an outline may be chosen from an existing library.

The lines of fill may be single rows of stitch points.

The lines of patterns may be single rows of stitch points.

Where the specified area is part of a complex shape, the method includes the following additional steps:

(a) calculating the positions of stitch points to fill all the other parts of the complex shape according to the calculating step, and (b) calculating connecting stitches between the parts: where (c) the positions of stitch points are calculated to fill the entire complex shape, and the lines of fill and the lines of patterns extend continuously outer all parts of the complex shape.

A second stitch definition curve may be used. The second curve may be specified independently of the first. Alternatively, the second curve may be generated from the first. In this case the second curve may be offset and either translated or dilated from the first. The lines of fill and the lines of patterns may be curved in dependence upon both the stitch definition curves.

Where only a single curve is specified two stitch definition curves may be generated automatically from it for use in the calculation.

Where more than two stitch definition curves are used, pairs or adjacent stitch definition curves are used to calculate the positions of stitch points for different parts of the area.

The step of calculating the positions of stitch points to fill an area, may calculate stitch points to fill an area which is larger than and contains the area to be filled. The stitch points which fall outside the area to be filled may then be discarded, so that only the stitches inside the area to be filled are recorded.

The steps of calculating the positions of stitch points may be such that the stitch points extend along straight lines of fill, each of which in order of stitching has a first edge point at one edge of the area, a series of intermediate points and a second edge point at another edge of the area, and such that the intermediate stitch points extend across the lines fill to form straight lines of patterns made up of single stitch points or groups according to the characteristics of the stitch type. Then the positions of stitch points may be transformed such that the lines of fill and the lines of patterns become curved in dependence upon the stitch definition curve.

As a precursor there may be an initial step of transforming the outline shape of the area to be filled using a transform that converts the shape made by two stitch definition curves which are joined at either end by straight lines, into a rectangle. In this case the positions of the stitch points of the transformed outline shape are calculated. Then the positions of stitch points are transformed using the inverse transform which returns the rectangle back to the shape defined between the two stitch definition curves which are joined at either end by straight lines, and which also returns the transformed outline shape back to the outline shape.

The outline shape of the area may be converted into a series of straight line segments before transforming it.

An "affine transform", or affine like transform, may be used, as described in detail later.

The fill stitching may comprise single lines of stitches or any stitch type, for instance tatami stitch type, program fill stitch type, and motif fill stitch time. They include complex stitching, with or without holes.

The advantages of the transform method of stitching include that it provides many new curved stitching variations using many existing calculation methods for straight stitching. They include both basic methods as well special effects, for many different stitch types. It is also possible to control the curvature of the stitching independently of the shape to be filled. Further, it is possible to ensure that the intermediate stitch points along lines of stitching form smooth visual patterns, without discontinuities. This is achieved where there are no discontinuities in the straight line stitches.

In a further aspect, the invention is a computer aided embroidery design system for generating the positions of stitch points for use by automatic embroidery machines to fill shaped areas in embroidery designs.

The System Including

Data input means to receive specifications for an area in the design to be filled with stitching, specifications for a stitch type of embroidery fill stitch to fill the area, and specifications for a stitch definition curve.

Computation means to calculate the positions of stitch points to fill the area, such that the stitch points extend along lines of fill, each of which in order of stitching has a first edge point at one edge of the area, a series of intermediate stitch points and a second edge point at another edge of the area, and such that the intermediate stitch points extend across the lines of fill to form lines of patterns made up of either individual stitch points or groups of stitch points according to the characteristics of the stitch type, and where the lines of fill and the lines of patterns are curved in dependence upon the stitch definition curve but not on the shape of the area to be filled.

And

Memory means to record the positions of the stitch points which extend throughout the area.

In another aspect, the invention is a series of stitch commands for controlling an automatic embroidery machine to fill a shaped area in an embroidery design. The series including:

A series of sequenced positions of stitch points to fill the area, where the stitch points extend along lines of fill, each of which in order of stitching has a first edge point at one edge of the area, a series of intermediate stitch points and a second edge point at another edge of the area, and such that the intermediate stitch points extend across the lines of fill to form lines of patterns made up of either individual stitch points or groups of stitch points according to the characteristics of the stitch type, and where the lines of fill and the lines of patterns are curved in dependence upon an extrinsically defined stitch definition curve but not on the shape of the area to be filled.

It should be realized that the designer may be human, but it is also conceivable for the design to be generated by a computer system which chooses and makes these inputs available to the invention without human operator input, provided of course that it has means to select or define shapes and the relevant stitching parameters automatically.

BRIEF DESCRIPTION OF THE DRAWINGS

In the drawings that follow, a convention has been adopted to represent needle penetration points as dots 1, and stitches as straight lines 2 that interconnect the dots.

1*a*. Is an outline of the first vector shape 3 having a mixture of curved and straight edges.

1*b*. Is the shape, stitched along its outline, with "Running" stitch.

1*c*. Is the shape, stitched inside (filled) with "Satin" stitch type.

1*d*. Is the shape, filled with "Tatami" stitch type having a regular staggered offset pattern of stitch points extending diagonally across the lines of stitches.

1*e*. Is the shape, filled with "Program Split" type stitching using small circles as the pattern for intermediate stitch points along the stitch lines.

1*f*. Is the shape, filled with "Tatami", but with each adjacent line of stitches at a slightly different stitch angle: to give the effect of being fanned out.

1*g*. Is the shape with a triangular hole, and filled using "Complex Fill" with Tatami stitch type.

1*h*. Is the shape filled with "Contour Stitching" showing the problems of discontinuities in the visual pattern of the intermediate stitch point, and large density increase where the shape narrows.

1*i*. Is the shape with the hole, and filled with "Motif Fill" stitch type, having a small diamond shape as the motif.

Figure 1A:
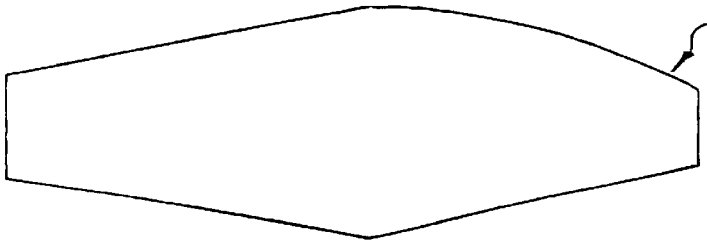
FIG. 1 illustrates a series of examples of known stitch types within a first shape 3.
Figure 1B:
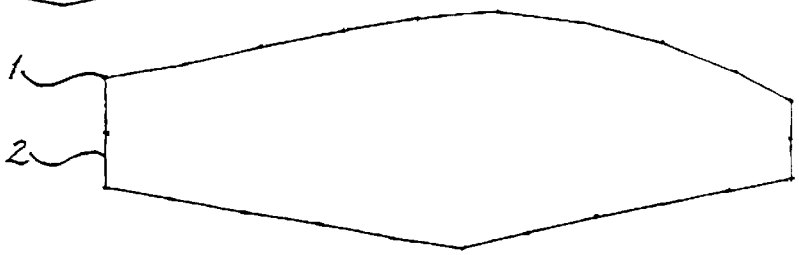
Figure 1C:
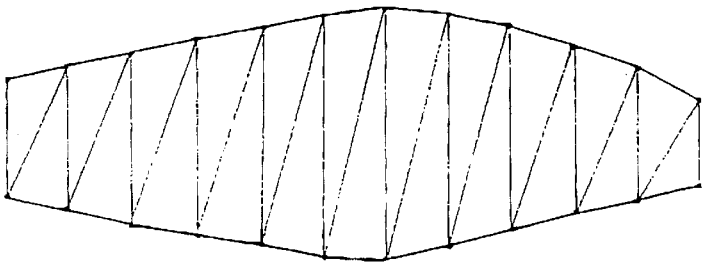
Figure 1D:
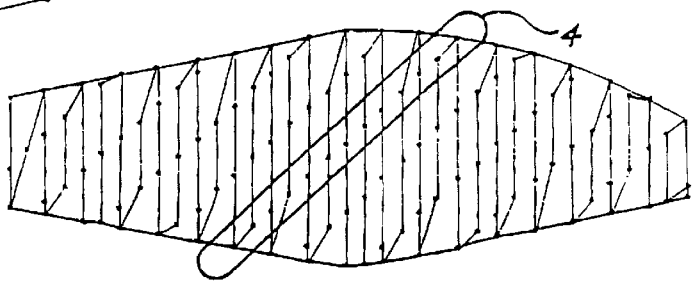
Figure 1E:
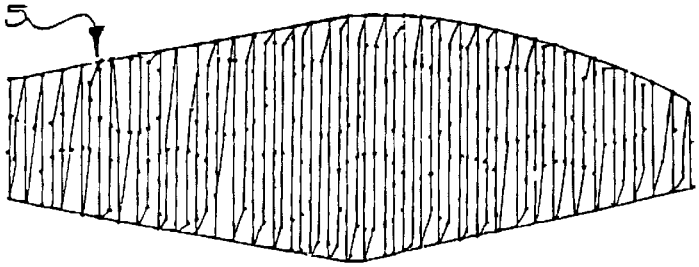
Figure 1F:
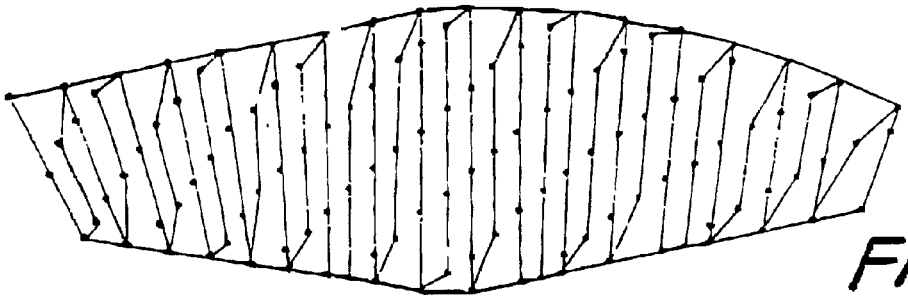
Figure 1G:
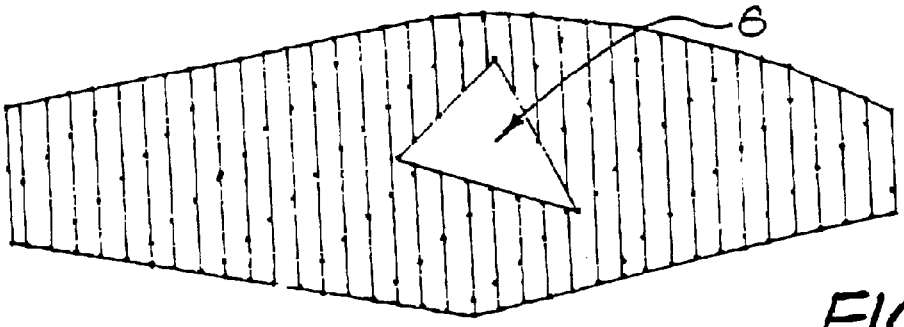
Figure 1H:
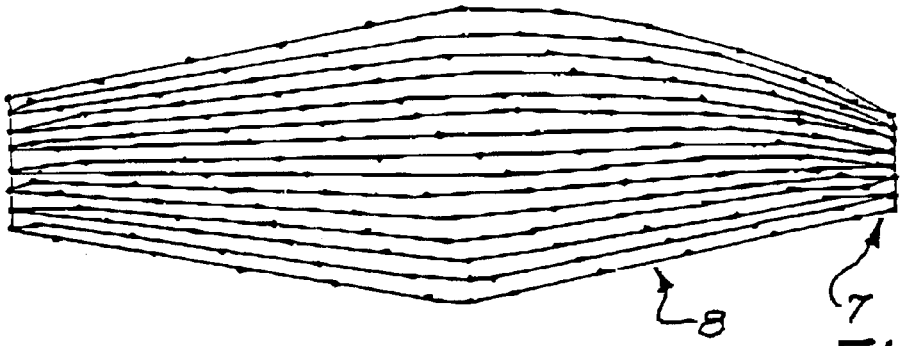
Figure 1I:
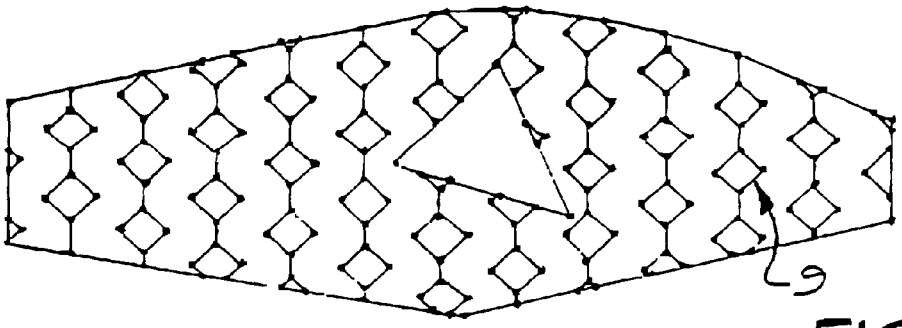
Figure 2A:
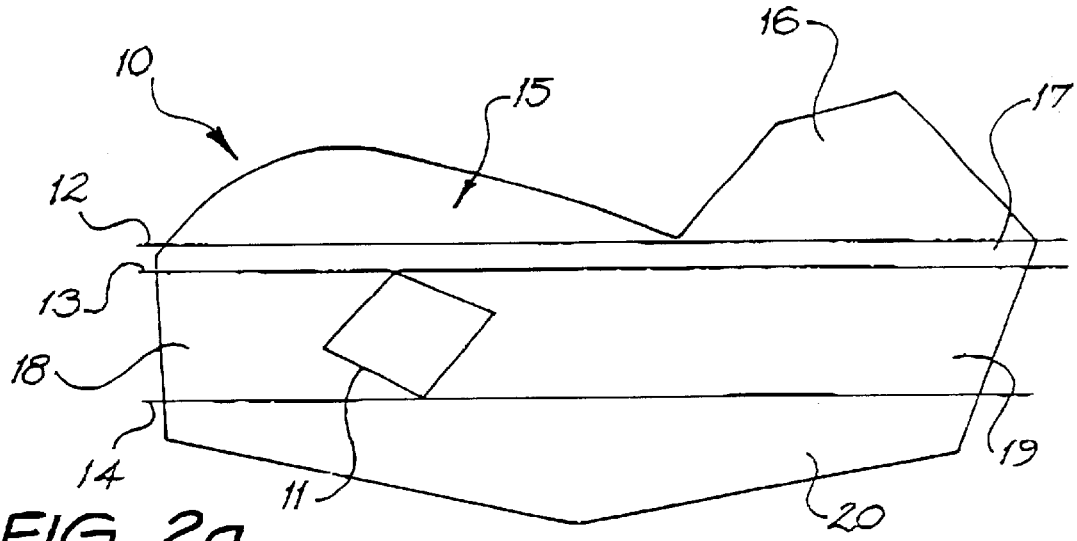
Figure 2B:
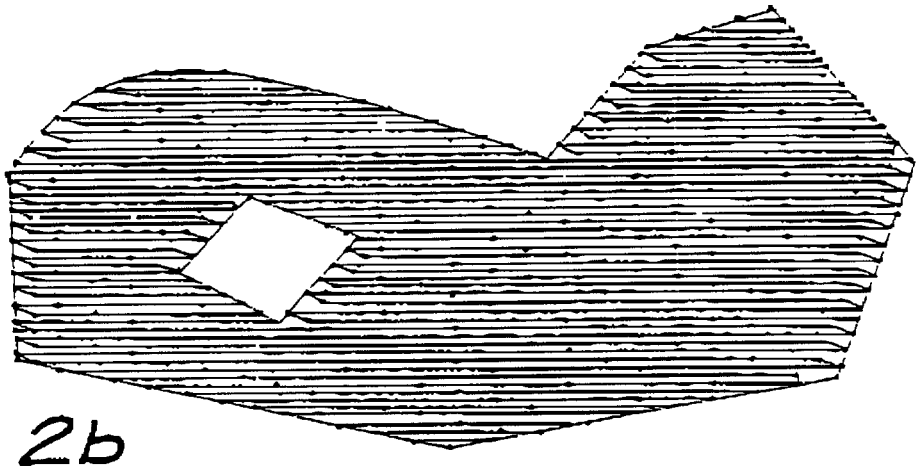
Figure 2C:
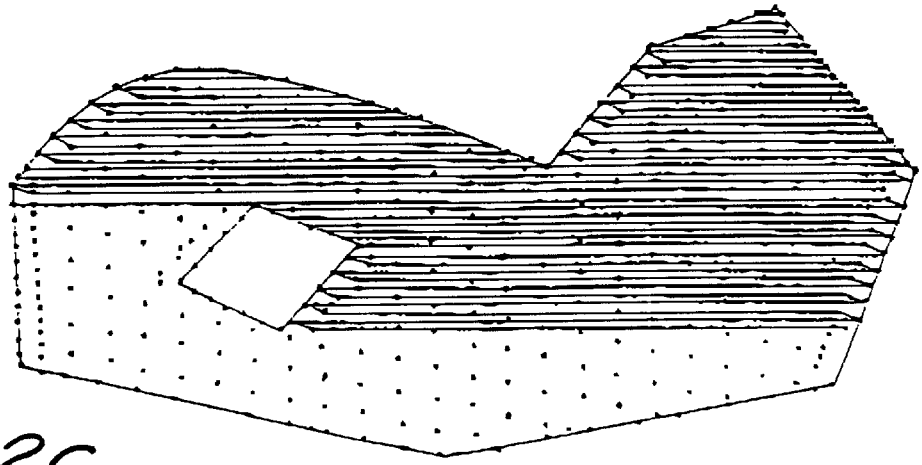

FIG. 2 illustrates an example of "Complex Fill" over a complex shaped area.

2*a*. Is the shape outline containing a diamond shaped hole.

2*b*. Is the shape outline of FIG. 2*a* after it has been filled.

2*c*. Is the shape outline of FIGS. 2*a* and *b* showing it partly filled.

Figure 3:
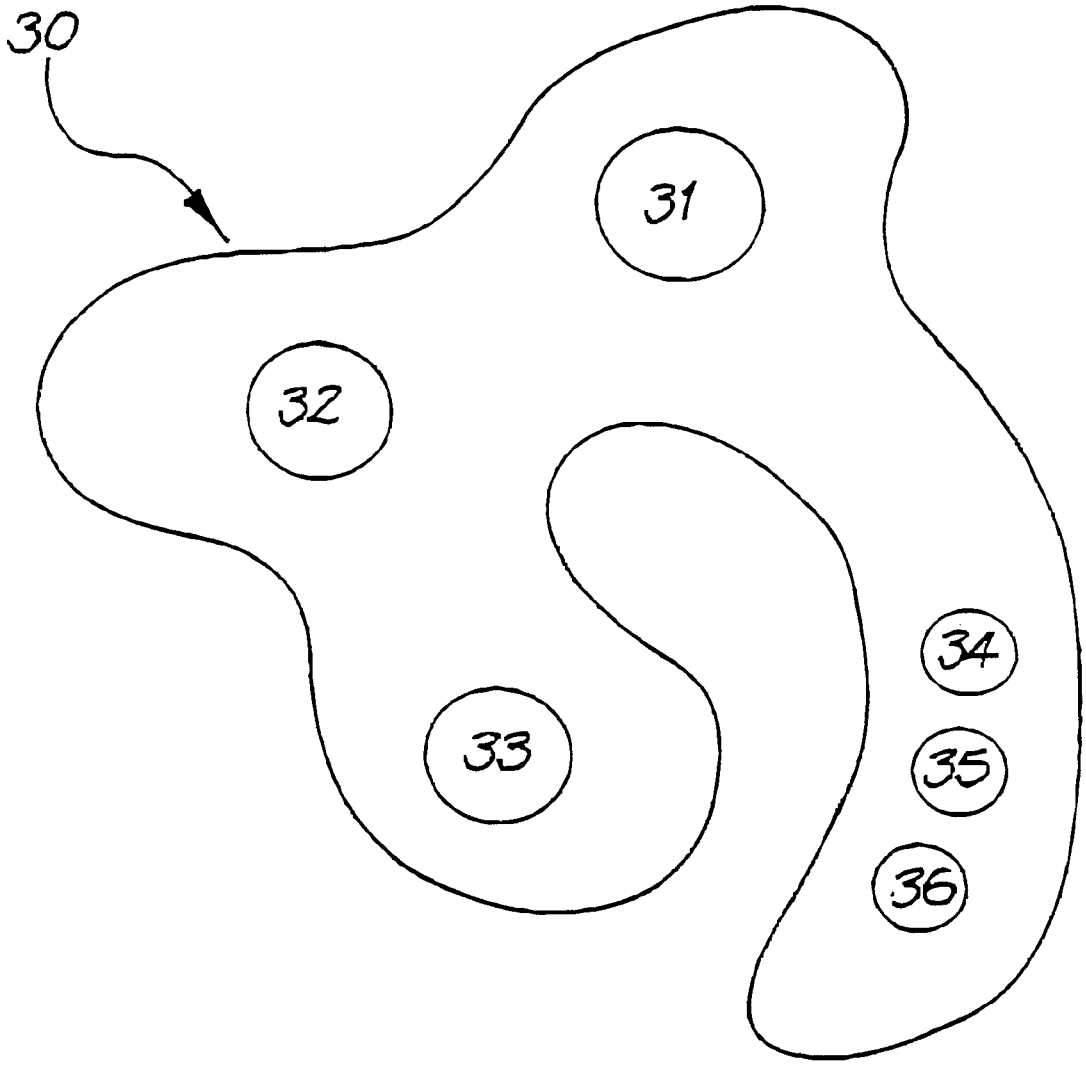

Examples of the invention will now be described with reference to the following drawings, in which:

FIG. 3 illustrates another complex shape to be filled.

Figure 4:
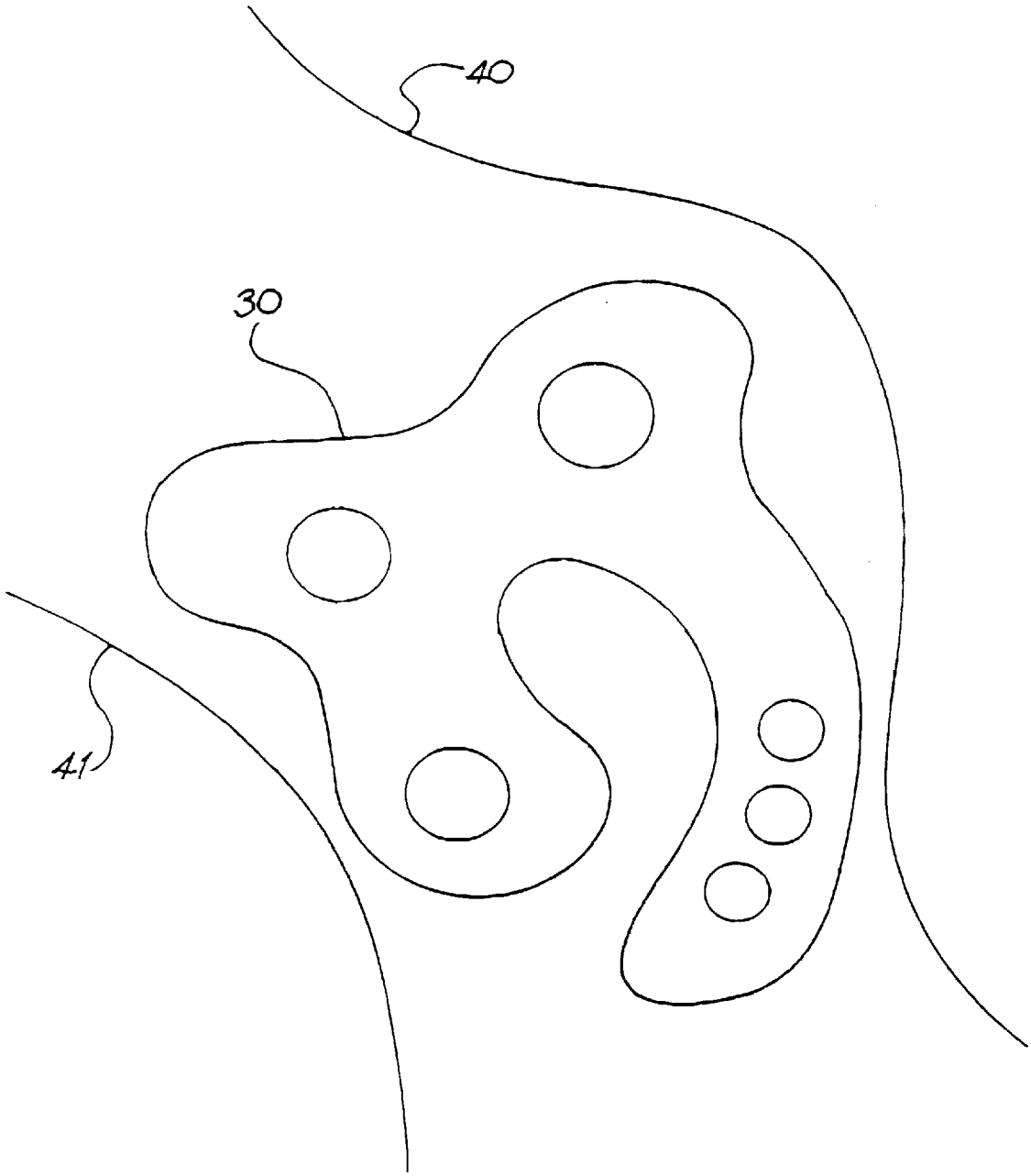

FIG. 4 is the shape bounded by two stitch definition curves.

Figure 5:
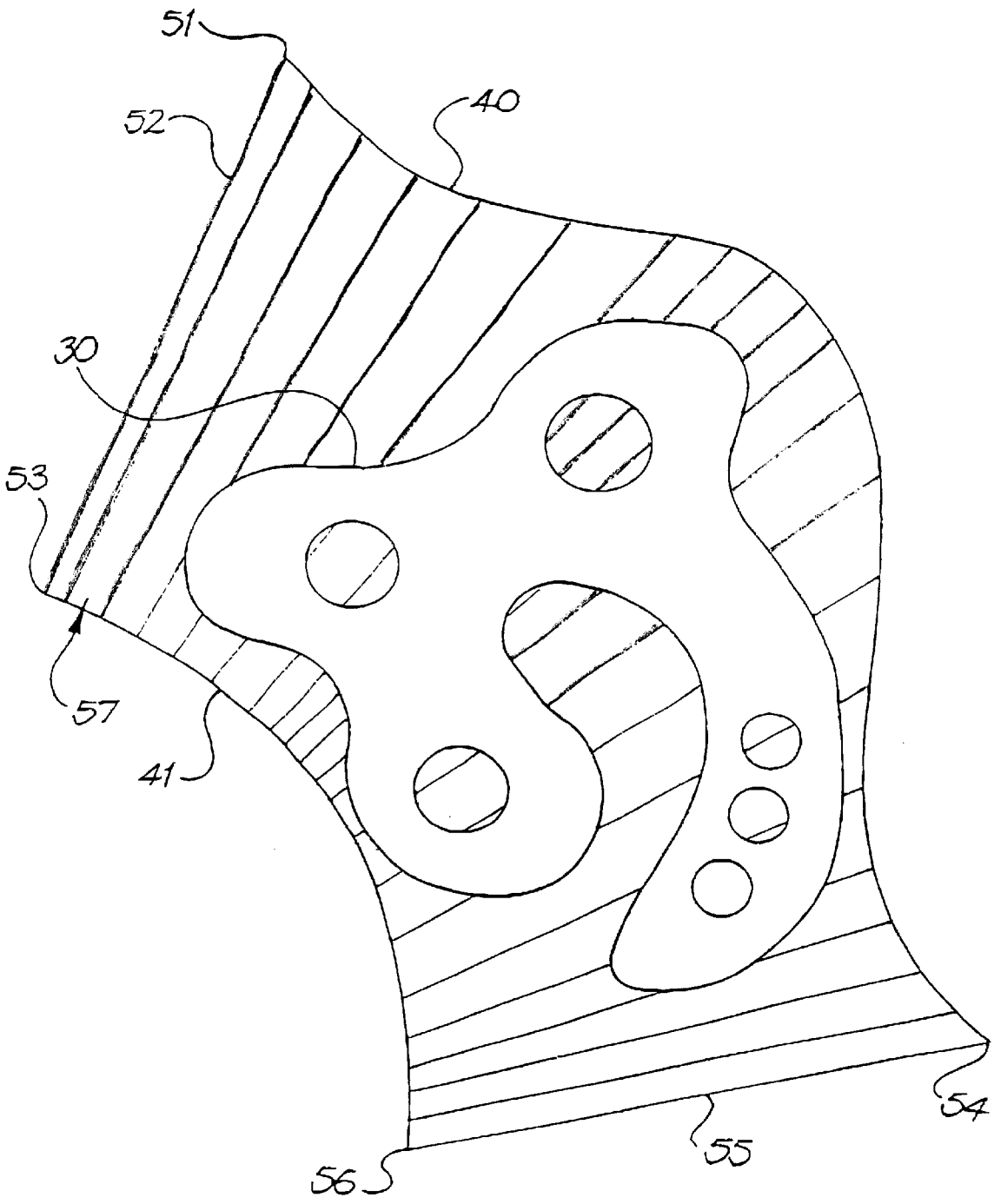

FIG. 5 is the shape with the two curves of FIG. 4 interconnected by a series of straight lines to form a series of quadrilateral slices.

Figure 6:
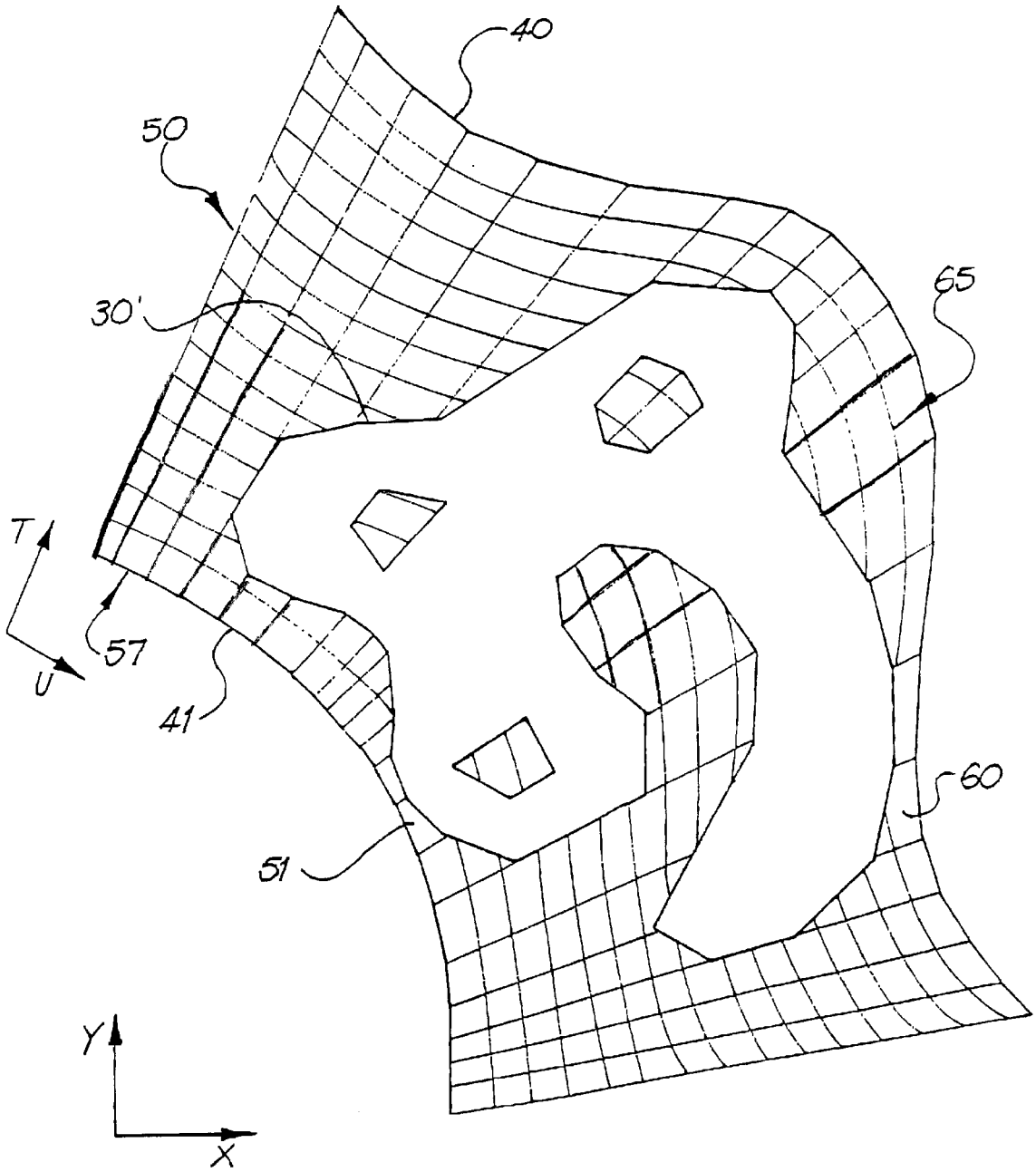

FIG. 6 illustrates a simplified shape superimposed on the quadrilaterals of FIG. 5 and in which a grid has been formed.

Figure 7:
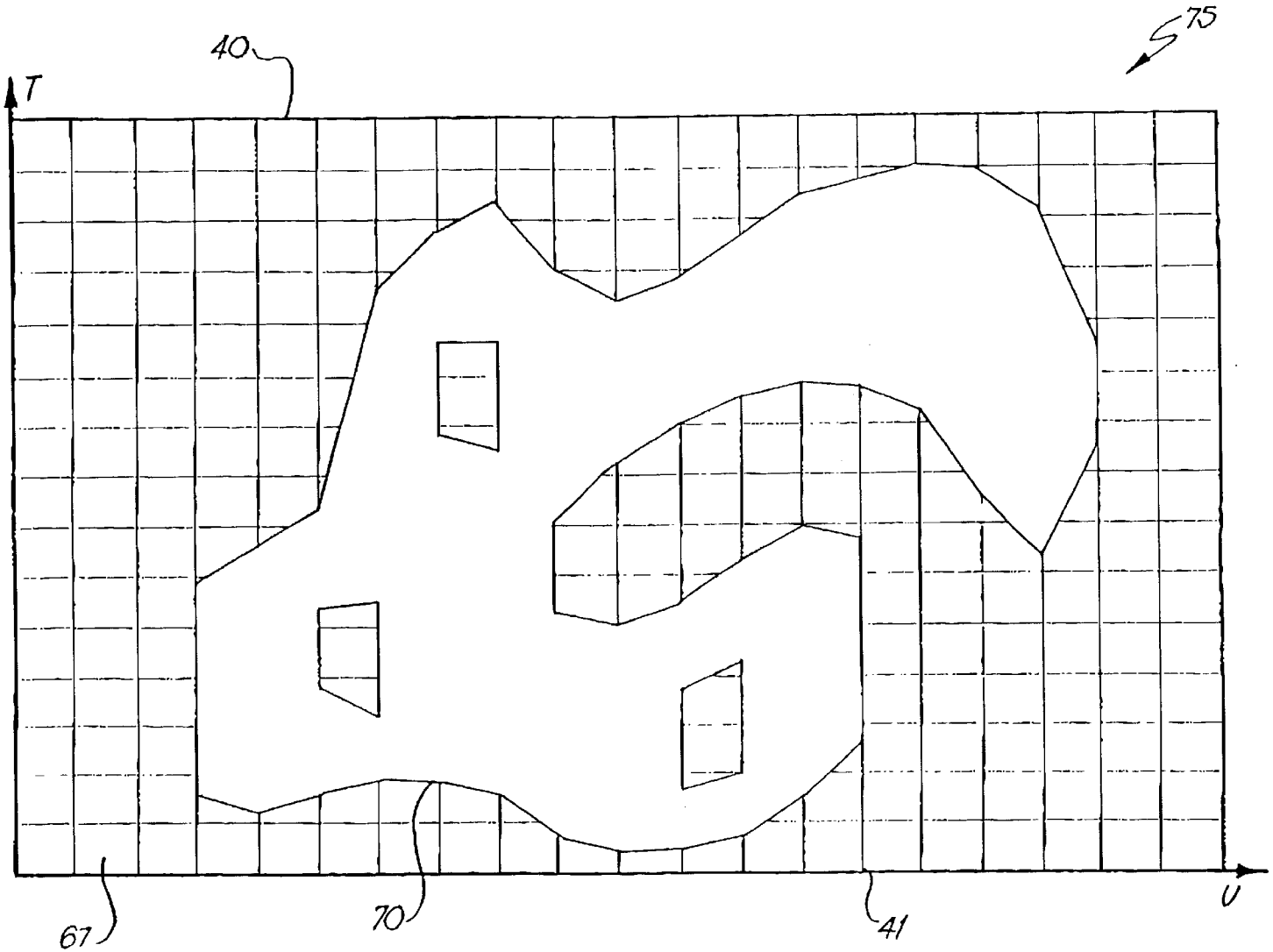

FIG. 7, is the shape of FIG. 6 after a transform has been applied to convert the grid into a rectangle.

Figure 8:
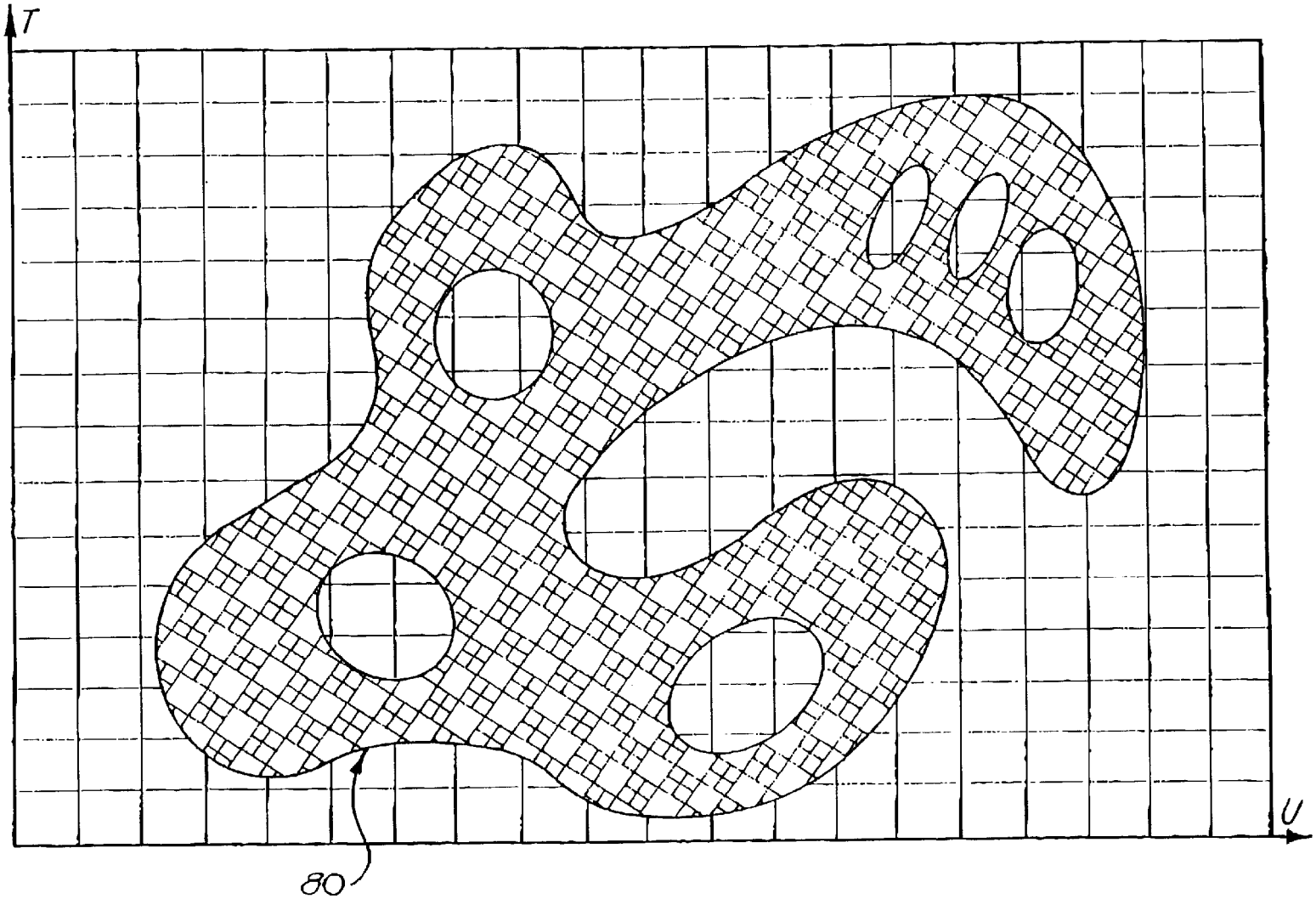

FIG. 8 is the transformed shape of FIG. 7 after straight lines of fill stitching have been calculated to fill it.

Figure 9:
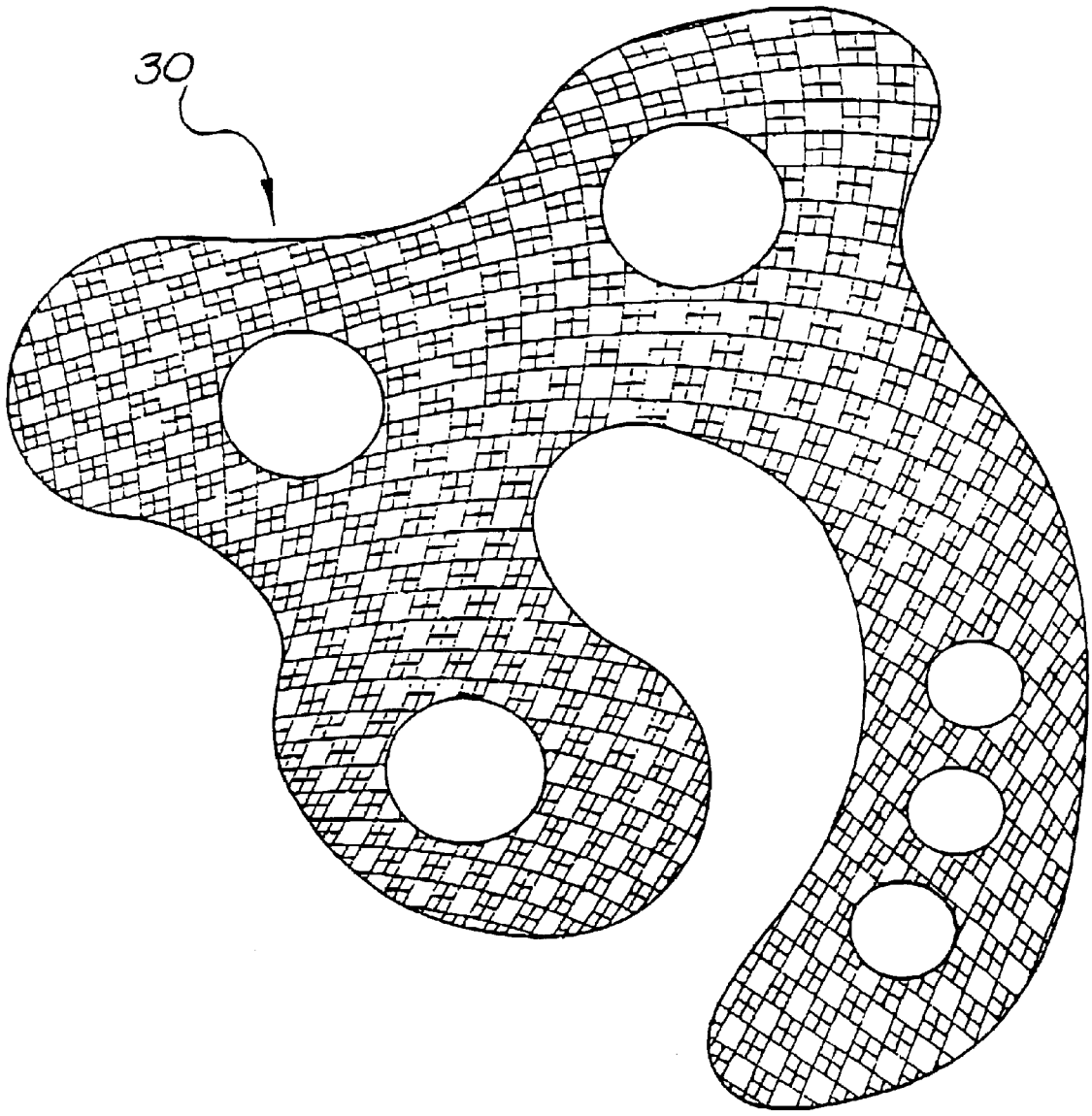
Figure 10A:
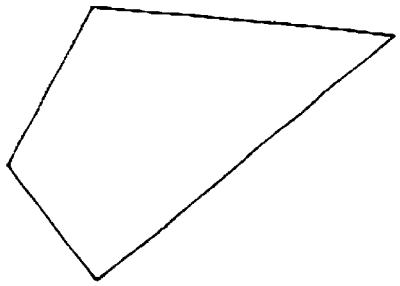
Figure 10B:
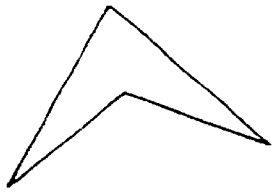
Figure 10C:
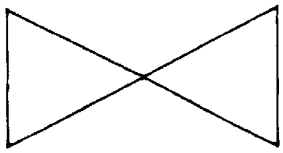
Figure 10D:
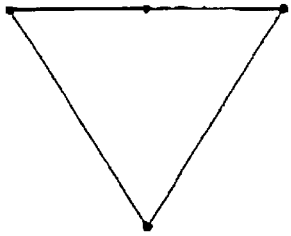

FIG. 9 is the shape recovered after the inverse transform has been applied, and now filled with curved lines of stitching.

FIG. 10 illustrates properties of quadrilaterals.

10*a*. Is a convex quadrilateral.

10*b*. Is a non-convex quadrilateral.

10*c*. Is a non-convex quadrilateral.

10*d*. Is a degenerate quadrilateral.

Figure 11:
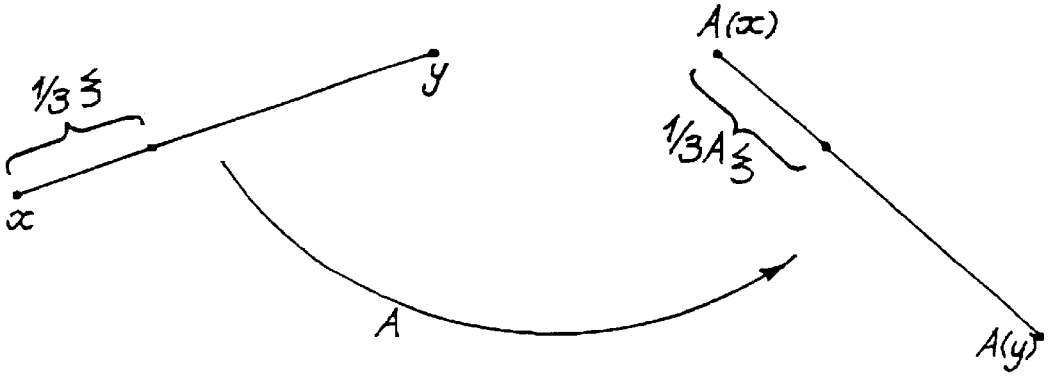

FIG. 11 illustrates an affine transform. If $\zeta$ lies on the line between x and y, then $A(\zeta)$ lies on the line between $A(x)$ and $A(y)$, moreover, the relative position of $\zeta$ between x and y is preserved.

Figure 12:
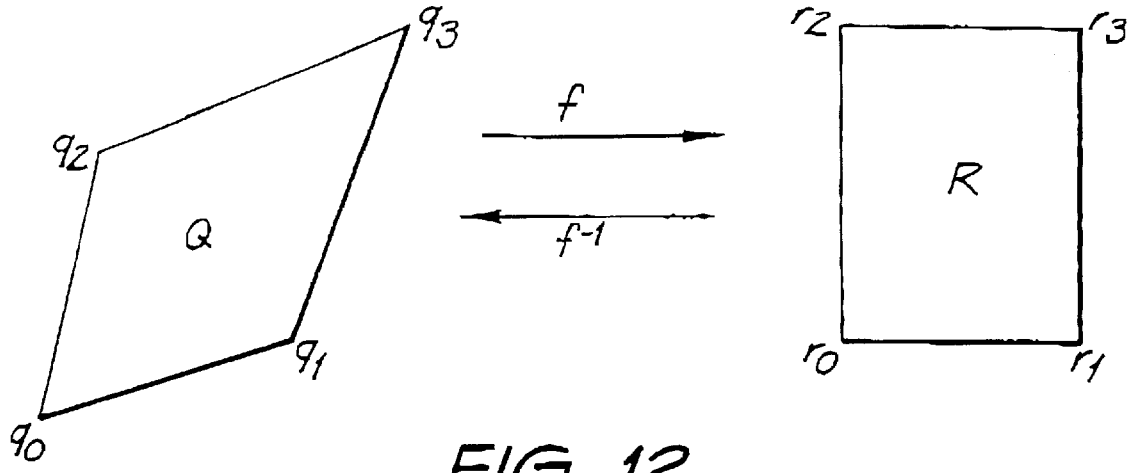

FIG. 12 illustrates the application of an affine transform to a completely general, convex, nondegenerate quadrilateral.

Figure 13:
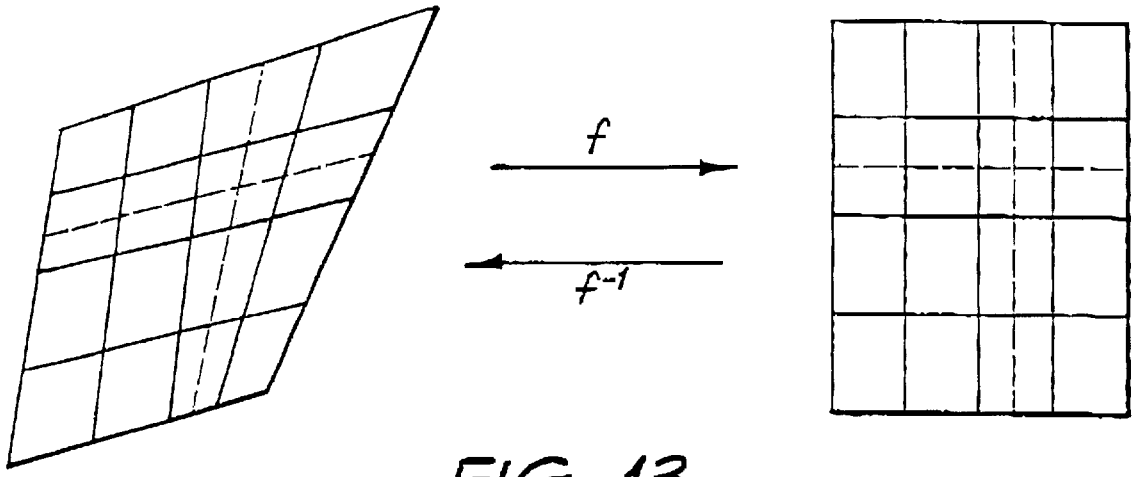

FIG. 13 illustrates the application of an affine transform to subdivisions within a completely general, convex, nondegenerate quadrilateral.

Figure 14:
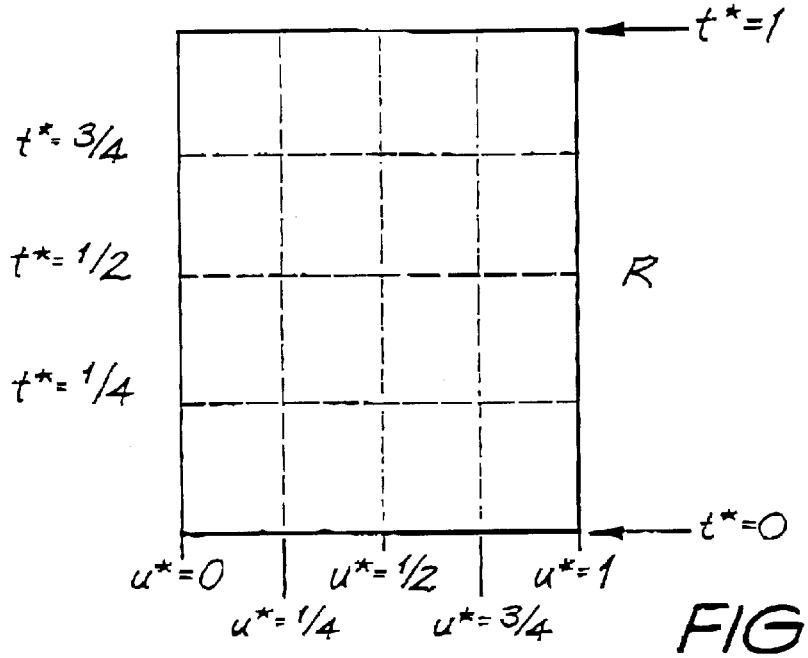

FIG. 14 illustrates fractional positions within the transformed quadrilateral.

Figure 15:
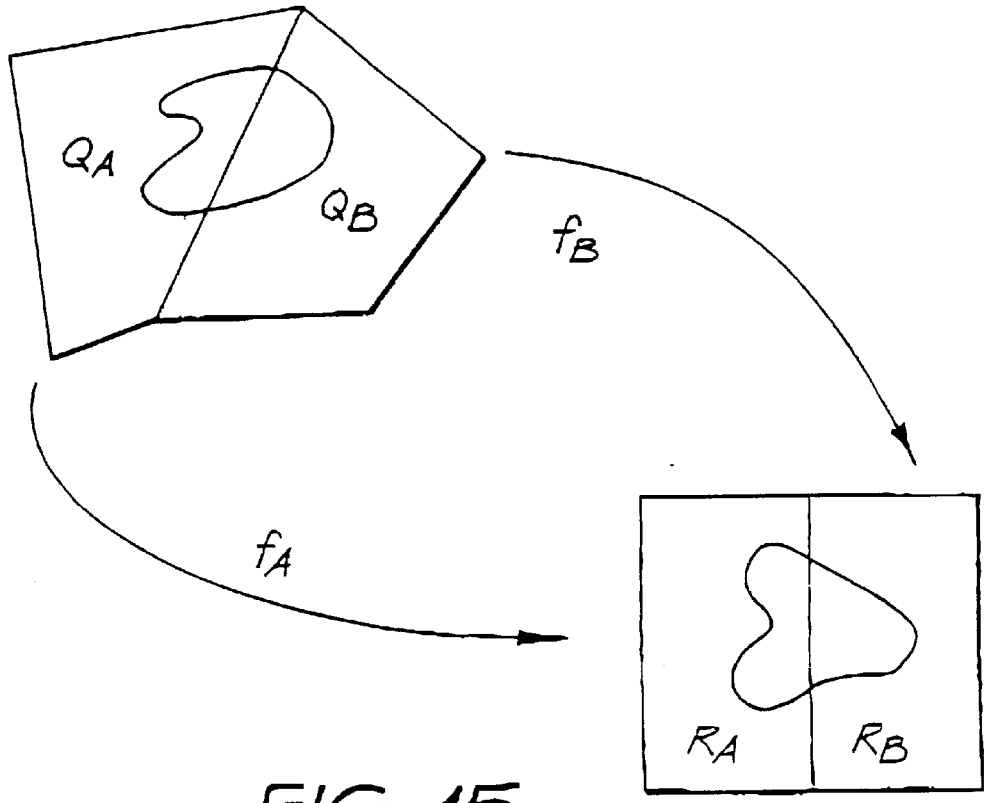

FIG. 15 illustrates the effect of the transform on an arbitrary shape extending across two quadrilaterals.

FIG. 16 illustrates a series of examples of stitching effects created using the invention.

16*a*. Is a shape filled with curved tatami stitching.

16*b*. Is the shape with a triangular hole filled with curved tatami stitching.

16*c*. Is the shape with the triangular hole filled with different curved tatami stitching.

16*d*. Is the shape filled with curved "program split" stitching having the circle effect.

16*e*. Is the shape with the triangular hole filled with curved lines of "Motif fill" having a diamond motif.

16*f*. Is the shape filled with curved tatami stitching and having a jagged edge effect.

16*g*. Is a different shape filled with curved tatami stitching showing a variation in stitch density across the shape.

FIG. 17 illustrates "Complex Fill" created using the invention.

17*a*. Is a shape having a triangular hole filled with curved complex fill and two stitch definition curves.

17*b*. Is the shape of FIG. 17*a* with the stitching displayed to illustrate the segmenting of the complex fill along the curved lines.

Figure 18:
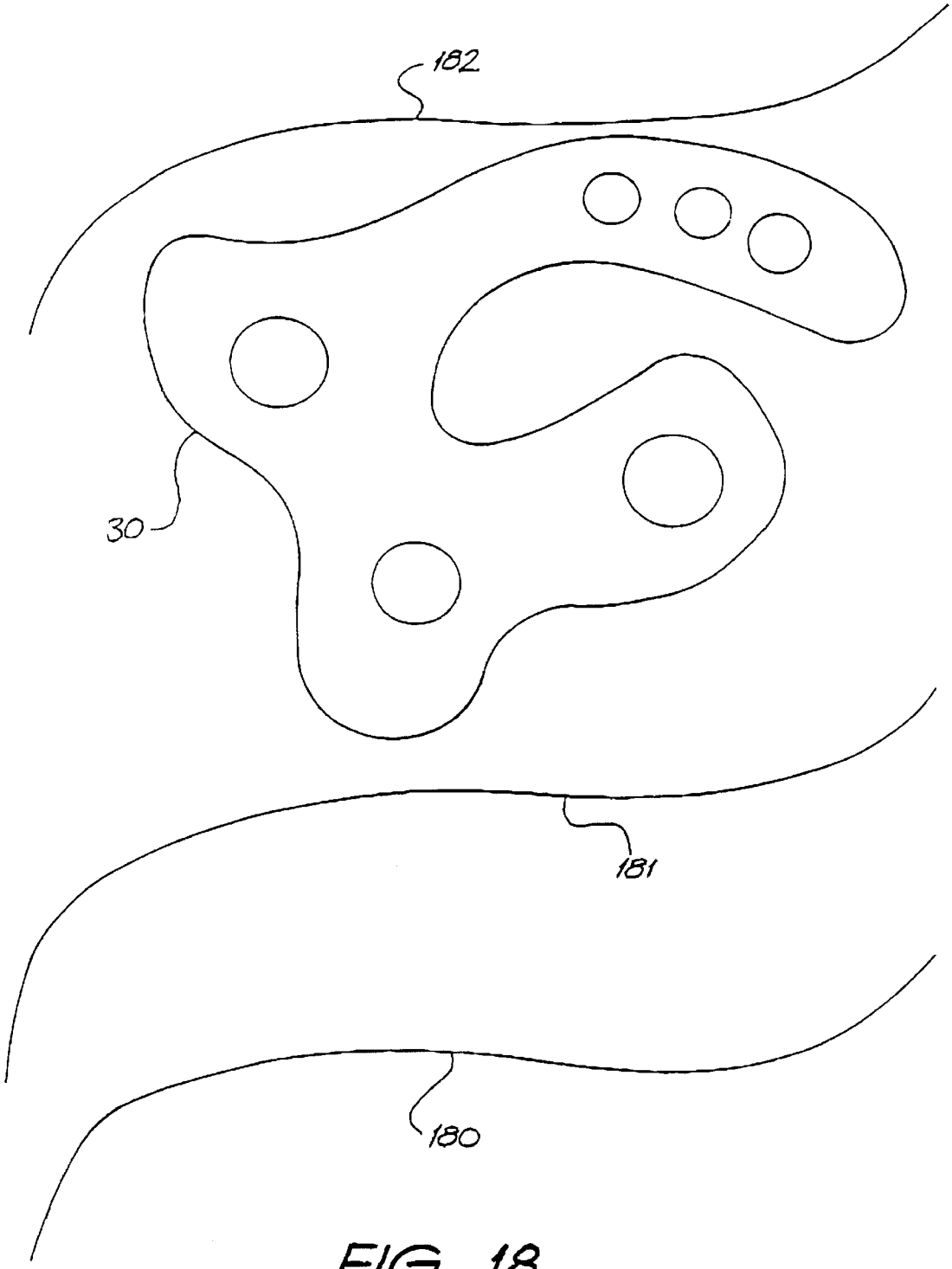

FIG. 18 is the shape of FIG. 3 where one curve has been specified and two replicas of it has been automatically generated to form a pair of stitch definition curves.

Figure 19:
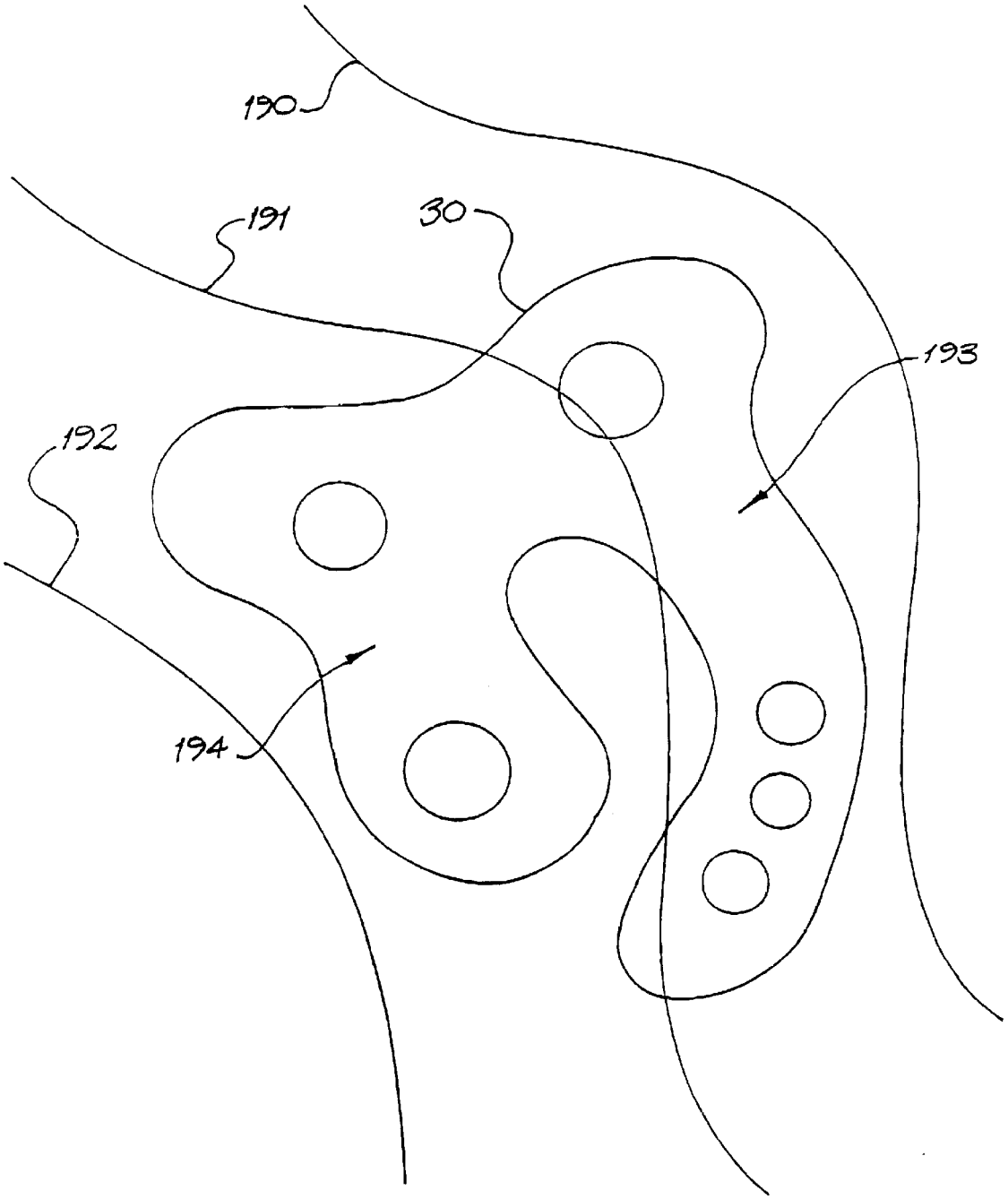

FIG. 19 is the shape of FIG. 4 showing three stitch definition curves.

DETAILED DESCRIPTION OF THE INVENTION

Example 1

Two Stitch Definition Curves

To produce curved stitching to fill any shape, the following steps are followed:

Step 1. Specify Stitch Type and Associated Parameters

Using the keyboard or mouse, or other input device an operator selects and specifies the desired stitch type and its associated parameters. For example Tatami stitch type, stitch length=4.0 mm, stitch spacing=2.0 mm, offset fraction A=0.25, offset fraction B=0.25.

Step 2. Define the Area to be Filled with Stitching

Using the mouse, an operator defines an area 30 to be filled, as shown in FIG. 3. Typically by digitizing the closed shape outline of the area with a mixture of straight line segments and curve line segments, using known methods. Alternatively the operator might simply pick a shape that already exists. The shape may have multiple boundaries or a single boundary. The shape definition must conform to whatever rules the CAD system has for standard complex fill calculation method for straight stitching. In this case the shape 30 contains six holes 31, 32, 33, 34, 35 and 36.

Step 3. Define Two Stitch Definition Curves Above and Below the Area

The area is displayed to the operator as shown in FIG. 3. Using the mouse, the operator then draws two stitch definition curves 40 and 41 on either side of the area 30, as shown in FIG. 4. The two stitch definition curves set the bounds inside which the stitching lines will be calculated, and the curved contours to which the stitching is to conform. The two stitch definition curves lie one above 40 and one below 41 the area 30, and they are defined independently from the area to be filled. Of course, it is also permissible to coincidentally make the stitch definition curves match some or all of the area to be filled, if this is desired. The stitch definition curves may consist of a mixture of straight line segments and curves. It is necessary for later calculations that the stitch definition curves lie outside the extents of the area to be filled. It is preferred that the operator enforces this condition, but it is also envisaged that the computer could extend or move the lines outside the shape, if the operator did not.

Later multiple curved lines of stitching will be calculated such that they start out following the first stitch definition curve, and as they progress across the area to be filled, gradually and smoothly conform to the second stitch definition curve.

Step 4. Calculate a Series of Quadrilateral Slices Between the Two Stitch Definition Curves Data processing apparatus then calculates a series of quadrilateral polygons, or slices, between the two stitch definition curves 40 and 41, as illustrated in FIG. 5. The first point of the first curve 51 is joined by a straight line 52 to the first point of the second curve 53, and the last point of the first curve 54 is joined by a straight line 55 to the last point of the second curve 56 to form a closed shape which completely envelopes the area to be filled 30. A series of further straight lines is calculated, extending between the first and second curves between the first and last points to create a series of quadrilaterals, one of which is indicated at 57. The width of the quadrilaterals is determined by the curvature of curves and, and the straight lines are closer together where the curvature is greater.

The ends of each adjacent pair of straight lines define four points which are the vertices of a series of contiguous quadrilateral slices 57 extending between the two curves. The stitch definition curves are approximated by straight line segments which extend along the curves from vertex to vertex. The number of quadrilateral slices is chosen to give the desired degree of accuracy to this approximation (this is generally governed by the tolerance of the chording and in practice is greater than that shown). It is necessary that the lines defining the sides of the quadrilateral shapes do not cross each other. There are many known ways of calculating such straight lines between curves and along curves, so the detail of this calculation is not given here.

Step 5. Convert the Outline Shape of the Area to be Filled into a Series of Small Straight Line Segments The outline shape of the area to be filled is converted, if not already in this form, into a series of small straight line segments 60, which approximate the edges of the shape to the desired degree of accuracy, a simplified shape 30' is shown in FIG. 6. It is necessary to subdivide curved edges and long straight edges of the shape into several small vectors to preserve the correct shape after coordinate transformations are performed on the shape.

In the present example it is required that there is a straight line segment end point at even intersection point of the shape to be filled with each and every side of the quadrilateral slices. (This is not a general requirement.) The resulting definition of each boundary of the area to be filled is an ordered series of points defining small straight line segments around the closed shape.

Step 6. Transform the Quadrilateral Slices of XY Coordinates into Corresponding Rectangular Cells in UT Coordinates Each quadrilateral slice 57 which is defined by four coordinates in XY Cartesian coordinate space is transformed by a mathematical transformation defined below, such each quadrilateral slice 57 forms a rectangle 67 in UT coordinate space. The UT coordinates are defined as follows. The U axis coordinate is the distance along the line segment representation of the first stitch definition curve 40. The T axis coordinate is the distance along the straight line 52 joining the first points of the stitch definition curves.

By dividing each of the T straight lines into the same number of equal length pieces, and joining these pieces along the U axis a curvilinear gird 65 is formed around the shape, as shown in FIG. 6, which can assist in understanding the transformation. After transformation the U.T coordinate values can be drawn graphically as a rectangular Cartesian coordinate system, as shown in FIG. 7 with the transformed shape 70 shown in a rectangular grid 75.

For each quadrilateral slice defined by four vertices in XY coordinates, a corresponding Rectangular slice in the UT coordinate system is calculated as follows. The height (Tmax) of all rectangular slices must be the same to satisfy the criteria of a Cartesian coordinate system for later use in Complex Fill stitching calculations for straight line stitching. The height Tmax is chosen as the weighted average height of all the quadrilateral slices. The width of each rectangular slice is chosen as the average of the width of the top and bottom of that one quadrilateral cell. (An alternative is to use the maximum width.) Thus each rectangular cell has the same height (T), but different widths (U). (Note that the grid 65 does not represent this!)

Hence it can be seen that the curved stitch definition curves 40 and 41 are each mapped or transformed into straight lines at the top and bottom respectively of the rectangular UT coordinate system.

The transforms from XY coordinates to UT coordinates and back are defined later.

Step 7. Transform the Shape of the Area to Fill into UT Coordinates

The Shape of the Area to Fill with curved stitching has already been converted into a series of small straight line segments 60 in Step 5 above. Now each straight Line segment end point on the shape is transformed into UT coordinates. Start for example with any vertex of the Shape, and proceed around the shape, vertex by vertex. For each such vertex point of the straight line segments, determine which quadrilateral slice, Qi, the point lies within. Calculate the corresponding UT coordinates of that point on the shape, according to the transformation calculation for that respective quadrilateral slice, according to the XY to UT Transform calculation. Note that each quadrilateral slice has a slightly different transformation. Store the list of UT coordinates of the line segments defining the shape to be filled. The simplified and transformed shape 770 is shown in FIG. 7.

Step 8. Calculate Stitches in UT space Using Standard Methods for Straight Line Stitching Since the two stitch definition curves have been transformed into parallel straight lines in UT coordinates, and since the shade to be filled has also been transformed into the UT coordinates, it is possible to use well known stitch calculation methods for calculating straight line stitching in UT coordinates. For example, Complex Fill calculations can be used for complex shapes. The shapes will be segmented along straight lines, the segments of stitching automatically sequenced, and stitching will follow straight lines as per the pre-existing complex fill calculations, except that these straight lines are all in UT coordinates.

The stitch spacing distance between adjacent lines of stitching in UT coordinates is approximately equal to the same distance in XY coordinates, because the range of UT coordinates approximates the actual measurements of the shape to fill, and stitch definition curves. There is some slight variation, but it will usually be within a few percent for typical cases. This variation is acceptable embroidery wise.

The value of stitch length parameter for tatami stitching used in UT coordinate calculations is the same as that in XY coordinates, eg 4.0 millimeters.

All the stitch calculation criteria and stitch type parameters of the chosen stitch type are used and calculated 'normally' using the known techniques for straight line stitching. So for example, in tatami stitching, the pattern formed by intermediate stitch points along the straight lines which are carefully calculated to have no visual discontinuities, are still calculated the same way in UT coordinates as in prior art systems. Similar for other stitch types such as Program Split, and Motif Fill.

Any other special stitching effects that are typically used for normal straight line stitching can also be used here in the UT (straight line) coordinate space. Things such as variable density effects (accordion spacing), jagged stitch effects, trapunto effect, etc can all be applied as in prior art systems. FIG. 8 shows the (unsimplified) shaped area 80 in UT space with straight line motif stitch filling it and straight line visual effects running across the lines of stitching.

Step 9. Transform the Stitches Back from UT to XY Space

The final step is to transform the UT coordinate stitches filling the shape back into XY coordinates. The original shape 30 is recovered, as shown in FIG. 9, provided sufficient accuracy is used to convert the stitch definition lines and original shape.

When the UT stitching coordinate points are transformed back into XY coordinate space, the straight lines of stitching in UT will become corresponding curved lines in XY space. The shape defined or filled by these curved lines of stitching is the original shape to be filled that was specified in Step 2 above.

The continuous smooth visual pattern of the intermediate stitch lines of the motif stitch which are straight lines in UT space, become curved lines in XY space.

So by calculating standard straight line stitch filling in the rectangular UT coordinate system, using known stitch calculation methods such as complex fill and the like, and then mapping the stitches back to the XY coordinate system, the resulting stitching fills the shape to be filled by following curve lines instead of straight lines. And all special effects and stitching criteria, such as control of offset patterns, can be used, and then mapped back into a smooth representation in curved line stitching.

The resulting stitching instructions are then recorded in stitch data format so that they can be used by an automatic embroidery machine to embroider the shape with the curved fill stiches having the curved visual effect.

Mathematical Transform Equations for UT and XY Coordinate Mapping

In the description that follows, the following definitions are used:

Nondegenerate Convex Quadrilateral (illustrated in FIG. 10*a*): A quadrilateral is convex if it does not possess any inward corners (illustrated in FIG. 10*b* and *c*). It is nondegenerate if it encloses a definite area, and there is a distinct angle between each pair of edges; that is, no two successive edges are parallel (illustrated in FIG. 10*d*).

Unit Square: the set of all points in a co-ordinate system whose two co-ordinates both lie between zero and one.

Affine Transformation: A transformation of a plane which maps straight lines to straight lines, and which preserves relative lengths, see FIG. 11. In computational terms, the transformation A is affine if it has the property that, for any points P and Q, and any number h between zero and one, the equation $$A((1-h)P+hQ)=(1-h),A(P)+hA(Q)$$

is valid.

Affine transforms are said to be determined by their values on three points. What this means is that given any three points of the plane, assumed not to lie on a common straight line, there is a unique affine transform which maps the three points onto another set of three given points.

Let Q be a nondegenerate convex quadrilateral, with vertices $$q_0=(x_0, y_0),\ q_1=(x_1, y_1),\ q_2=(x_2, y_2) \text{ and } q_3=(x_3, y_3),$$

in the order shown in FIG. 12; and let R be a rectangle with corresponding vertices $r_0=(u_0, t_0), \ldots, r_3$.

In general cells within the interior of a shape retain their relative positions during transformation and inverse transformation, as shown in FIG. 13.

In this section, we define the 'building-block' transformation f which maps Q to R, together with its inverse mapping.

We begin with the inverse (UT to XY) transform, because it is simpler to express.

A Formula for the UT to XY Transformation

Let r be a point of R, with co-ordinates (u,t), say. To begin with, we define an associated point in the unit square, r*, by the formula r*=(u*,t*), in which $$u^* = \frac{u-u_0}{u_1-u_0} \quad \text{and} \quad t^* = \frac{t-t_0}{t_2-t_0}.$$

These formulas express the fractional position of r in R. See FIG. 14 for an explanatory picture; note further that, in particular, $$r_0^*=(0.0),\ r_1^*=(1,0),\ r_2^*=(0,1) \text{ and } r_3^*=(1..1)..$$

In other words, the corners of R are associated with the corners of the unit square. Similarly, the centre of R becomes (0.5, 0.5), meaning that it is half-way across and half-way up, and so on. We now define the inverse (UT to XY) transformation $f^{-1}$ by the formula.

$$f^{-1}(r)=g(r^*),$$

in which g is given by the rule, $$g(u^*, t^*)=q_0+u^*,(q_1-q_0)+t^*,(q_2-q_0)+u^*t^*,((q_0+q_3)-(q_1+q_2)).$$

Notice the following properties of $f^{-1}$ and g:

(1) $f^{-1}$ maps the corners of R onto the corresponding corners of Q;

(2) $f^{-1}$ maps the edge of R connecting $r_i$ and $r_j$ linearly onto the edge of Q which connects $q_i$ and $q_j$ $$f^{-1}((1-hjr_i+h,0r_j)=(1-h)f^{-1}(r_i)+h,f^{-1}(r_j)=(1-h)q_i+h,q_j;$$

(3) g satisfies the equations:

$$g(u^*, t^*)=(1-t^*),g(u^*, 0)+t^*,g(u^*, 1).$$

$$g(u^*, t^*)=(1-u^*),g(0, t^*)+u^*,g(1, t^*).$$

The first part of (3) states that the image of a vertical line under g is a straight line in Q: the second is the corresponding statement for horizontal lines. Note however that straight lines in R (in UT coordinates) which are not aligned with the axes do not have straight XY-images in Q. Rather, the images are curves. These equations are used below; we shall refer to them as the distributive equations for g.

Equation (2) is of pivotal importance. It is equation (2) which ensures that the transformation has the following continuity property; let $Q_A$ and $Q_B$ be two quadrilaterals joined along a common edge, let $R_A$ and $R_B$ be two rectangles joined along corresponding edges, and let $f_A$ and $f_B$ be the transformations mapping $Q_A$ onto $R_A$ and $Q_B$ onto $R_B$. Now form a composite transform on the union of $Q_A$ and $Q_B$ by simply gluing $f_A$ and $f_B$ together. It follows from equation (2) that the composite transform is continuous across the interface between $Q_A$ and $Q_B$. So, in the application, it is consistent to split a complex-fill shape into pieces, to transform it piece-by-piece, and then recombine the images. This does not lead to any discontinuity. See FIG. 15.

So far, we have an explicit formula for computing the UT-to-XY transform $f^{-1}$. It turns out that the forward (XY to UT) transform f(x,y) is rather more difficult to evaluate. Here's how it's done:

Computing the XY to UT Transformation

First, let A denote the affine transform of the plane which maps $q_0$, $q_1$ and $q_2$ to the points (1.0), (0.0) and (0.1). Such a transform can certainly be found, because Q is assumed to be nondegenerate; the three vertices cannot possibly lie on a common straight line. Let (1+k,1−l) be the image of the fourth corner. $A(q_3)$.

Now, suppose some point (x,y) is given. We wish to find u* and t* such that $$g(u^*, t^*)=(x,y).$$

Note that it is simple to reconstruct u and t from u* and t*. Inverting the formulas which define u* and t* in terms of u and t, we have:

$$u=u_0+u^*,(u_1-u_0).$$

$$t=t_0+t^*,(t_2-t_0).$$

Now, from the equation g(u*, t*)=(x,y), it follows at once that $$A(g(u^*, t^*))=A(x, y),$$

and using the definition of A, that is, an affine function with the specified values at $q_0$, $q_1$ and $q_2$, and the distributive equations for g stated in property (3) above, we may compute that A(g(u*, t*))=(u*+ku*t*, t*+lu*t*). This is demonstrated by the following argument:

Using the distributive equations to expand the term in g, $$A(g(u^*, t^*))=A((1-u^*),g(0,t^*)+u^*,g(1,t^*))$$

from which it follows, by the defining property of an affine function, that, $$A(g(u^*,t^*))=(1-u^*),A(g(0,t^*))+u^*,A(g(1,t^*)).$$

Now expanding the terms in g using property (3) a second time, $$A(g(u^*,t^*)=(1-u^*),A((1-t^*),g(0,0)+t^*,g(0,1))+u^*,A((1-t^*),g(1,0)+t^*,g(1,1))$$

but the values of g here are now just the corners of Q, so $$A(g(u^*,t^*))=(1-u^*),A((1-t^*),q_0+t^*,q_2)+u^*,A((1-t^*),q_1+t^*,q_3).$$

Using once again the equation which characterises A as and affine function.

$$A(g(u^*,t^*),=(1-u^*(1-t^*),A(q0)+(1-u^*)t^*,A(q2)+u^*(1-t^*),A(q1)+u^*t^*,A(q3).$$

However, A was defined in terms of its values at the points $q_0$, $q_1$ and $q_2$, and substituting for these, we have:

$$A(g(u^*,t^*))=(1-u^*)t^*,(0,1)+u^*(1-t^*)(1.0)+u^*t^*,(1+k, 1+l),$$

which simplifies to the equation claimed above:

$$A(x,y)=A(g(u^*,t^*))=(u^*+k,u^*t^*, t^*+l,u^*t^*).$$

Now we unscramble this to calculate u* and t* from A(x,y). First, for convenience, let us write (x*, y*)=A(x,y). Splitting the vector equation into two scalar equations, we wish to solve $$x^*=u^*+k,u^*t^*.$$

$$y^*=t^*+l,u^*t^*.$$

These may be rearranged to give $$u^*=x^*-k,u^*t^*,$$

$$t^*=y^*-l,u^*t^*,$$

and multiplying these together, $$u^*t^*=x^*y^*-(ky^*+lx^*),u^*t^*+kl,(u^*t^*)^2.$$

And this is now a quadratic equation for the product u*t*. Note that all of the quantities k, l, x* and y* can be computed directly from A, x and y, and that A is in turn easily derived from the co-ordinates of the vertices of Q. (Precisely: A is given by the formula $$A(z) = \frac{(z'(q_2 - q_0) - z'(q_1 - q_0))}{(q_2 - q_0)'\ (q_1 - q_0)}$$

Where * represents the vector cross product.

So it is possible to solve this equation for u*t*, and hence from the previous pair of equations, to recover u* and t* individually. From there, we may easily calculate u and t, using the equation pair noted at the beginning of this section. This concludes the task of computing the forward transform.

Examples of Stitching Accomplished by the Invention

Figure 16A:
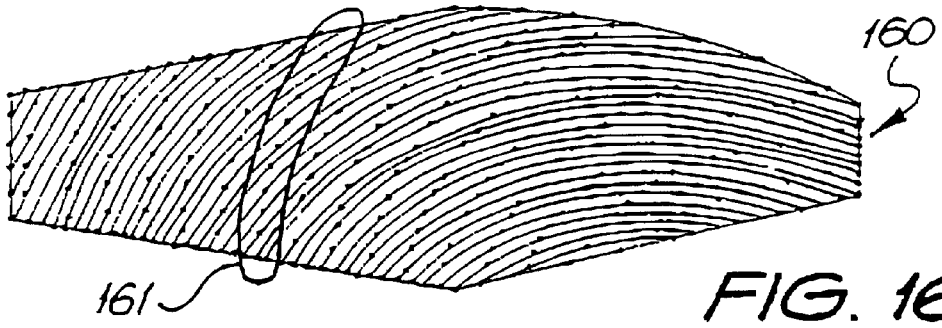

FIGS. 16*a* to 16*f* show areas having the same outline shape as those in FIG. 1. FIG. 16*a* shows the shape filled with curved stitching. The lines of fill, for instance 160, are shown by lines connected by dots running across the shape. In this case the "lines of fill" are rows of single stitch points. The lines of patterns, for instance 161, extend as curves across the lines of fill, and are easily seen by the curved effect of the dots in the drawing. In this case the lines of patterns are also single lines of stitch points.

Figure 16B:
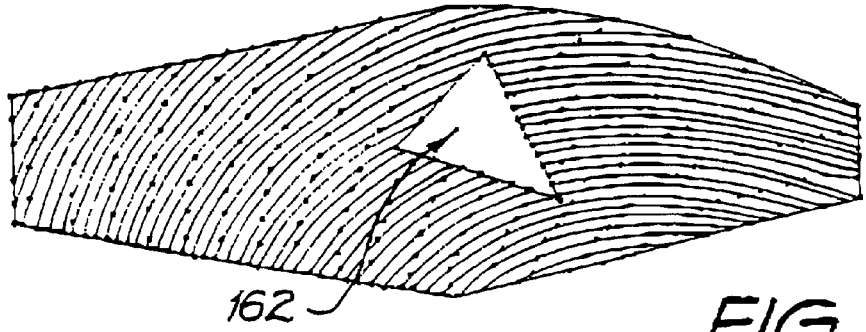

In FIG. 16*b* a complex shape is created by the addition of hole 162. It can be seen that both the lines of fill and lines of patterns extend continuously throughout the area and around the hole 162.

Figure 16C:
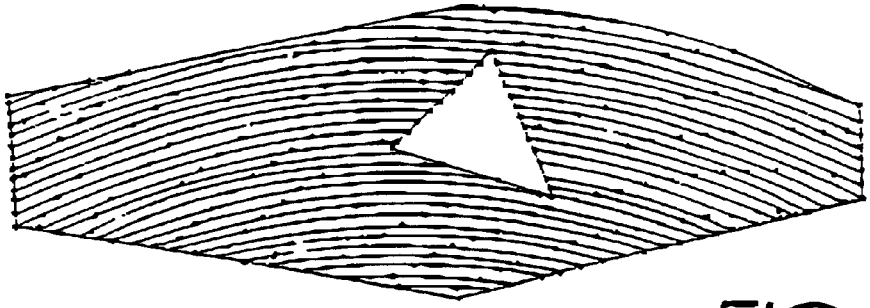

FIG. 16*c* shows an area the same outline shape as FIG. 16*b*, but in which the lines of fill and lines of patterns are different.

Figure 16D:
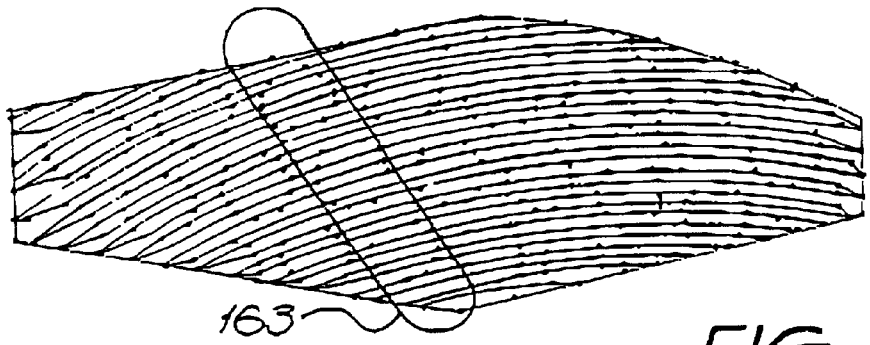

In FIG. 16*d* the lines of fill are as before, but in this case the lines of patterns are groups of stitch points which extend across the lines of fill as shown at 163. In this case the stitch points are arranged according to a "program split".

Figure 16E:
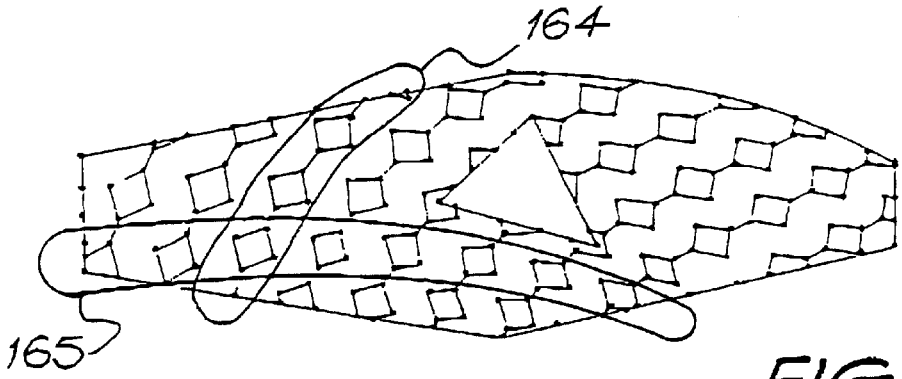

In FIG. 16*e* a motif fill is used, and the lines of fill, such as 164, comprise a series of diamond shapes linked together and extending across the shape. The lines of patterns, for instance 165, extend across the lines of fill.

Figure 16F:
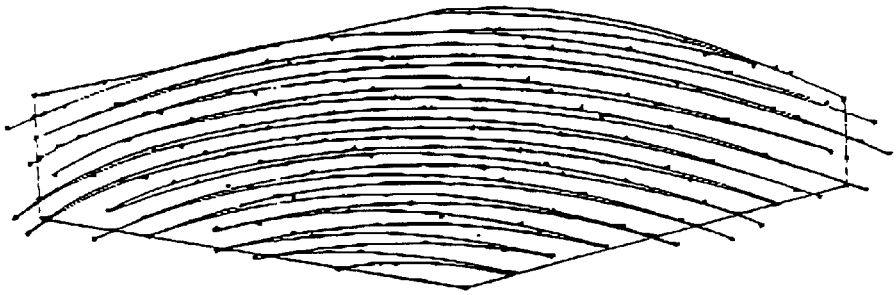

FIG. 16*f* shows curved stitching throughout the area, but having a jaggered edge effect.

Figure 16G:
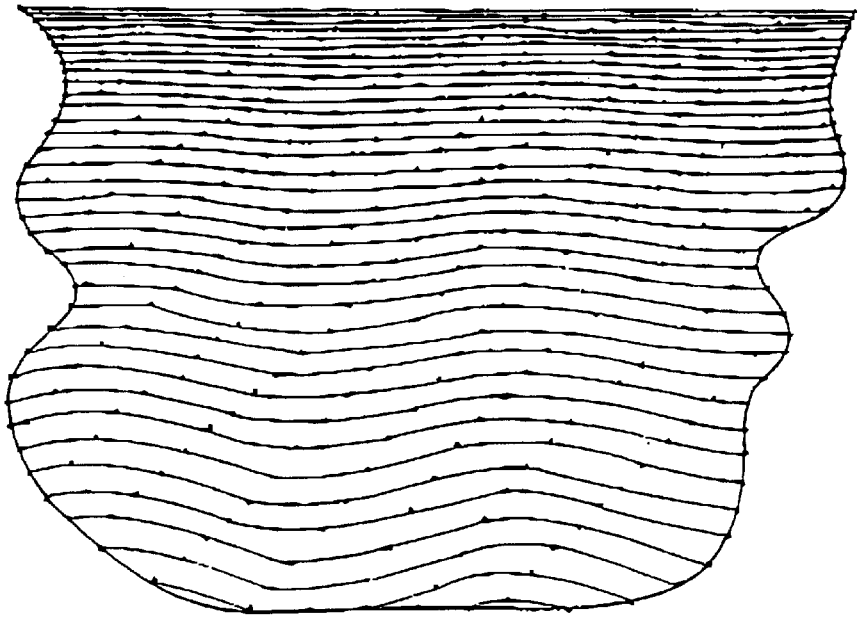

FIG. 16*g* is a different shape filled with curved stitching showing a variation in stitch density across the shape. Stitch density increases up the shape.

FIG. 17 illustrates an example in which curved lines of fill are applied to a complex shape, similar to the shape in FIGS. 16*b* and *c*.

Figure 17A:
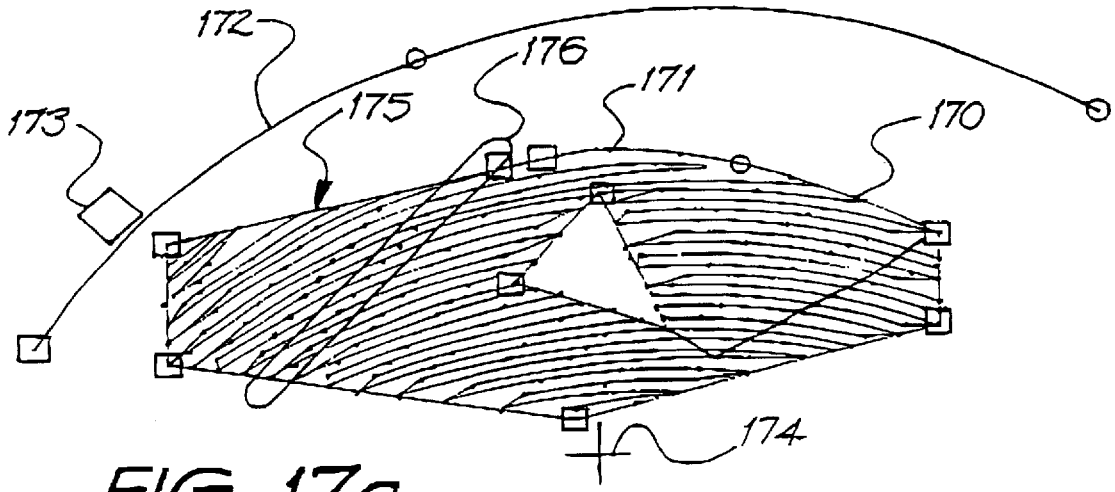

In FIG. 17*a* the shape 170 encloses an area in which there is a triangular hole 171. The two stitch definition curves 172 and 173 are positioned on either side of shape 170. The square and the small circles on the stitched definition curves are the control points used to create those curves. The diamond symbol 173 is the starting point for stitching the area bound by this shape and the + symbol 174 represents the ending point for stitching. In this case the lines of fill are single rows of stitch points, such as the one indicated at 175, and the lines of pattern extend across the rows of stitches as indicated in 176.

Figure 17B:
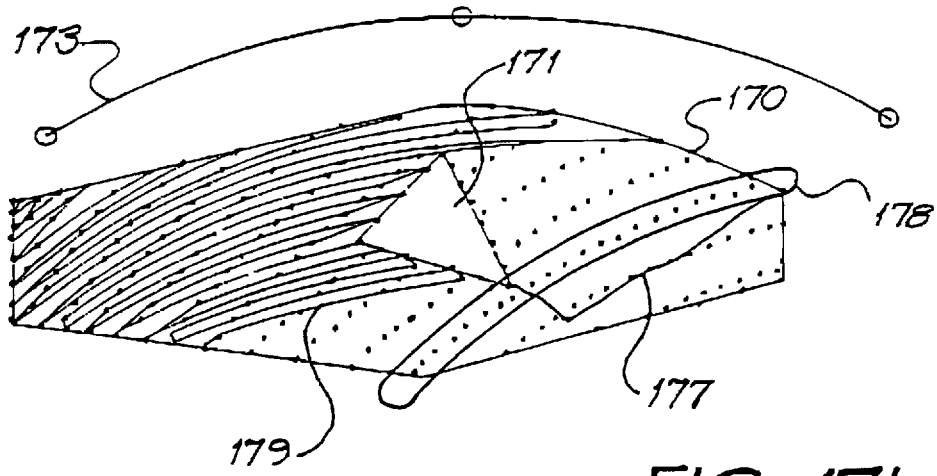

FIG. 17*b* illustrates the shape of FIG. 17*a,* but in which some of the stitches are displayed only as dots rather than straight lines and dots. Additional stitching travels from the end of one segment to the beginning of the next segment of stitching, for instance 177. In this figure the lines of patterns are clearly seen as the lines of dots on the left hand side, for instance 178, and the line of fill 179 can clearly be identified.

Example 2

A Single Curve is Entered

This variation of the invention uses almost the same steps as above, with a few exceptions. First, only one curve 180 is specified, as can be seen in FIG. 18. However, two stitch definition curves are still used in the calculations, but they are calculated based on the single stitch definition curve specified, in a manner described below. The curves are calculated such that a uniform stitch density is provided across the shape being filled.

Now we discuss the problem of generating curved stitching on a complex-fill shape from a single stitch definition curve. The technique is to derive from this single curve 180 two new stitch definition curves which bound the complex fill region; the stitching is then generated using the two-curve form of the invention, i.e. following u-co-ordinate lines between the two new curves.

The two new curves meet two key requirements; they are chosen in such a way as to minimise the variation in the distance between the U-co-ordinate lines, in order that the variation in density of the resulting stitching be minimised; and they are chosen with the property that the original single curve is as close as possible to one of the U-co-ordinate lines, in order that the curved-stitching follow the original curve accurately.

Now we describe the process by which the system computes two curves from the original one. First, we define the following terms:

Translation: moving a curve without rotation or distortion. The resulting curve is called a translate of the original.

Offsetting: forming a curve, called an offset, at a constant distance from a given curve.

Dilation: re-scaling a curve about some point.

We shall refer to a curve as translatable if it is possible to translate it in some direction without any of the translates crossing one another. The geometric criterion for translatability is that the tangent field of the curve turn through less than a half-circle. Similarly, we shall refer to it as dilatable if there is some point about which the curve can be dilated without the images crossing one another.

Offsetting is the preferred way to create the two boundary curves, because it leads to zero variation in density. However, it is in general impossible to create two offsets sufficiently far from the original curve that they enclose the given complex-fill shape. If a curve is translatable or dilatable, it is possible to create using translates or dilated images a patch of stitching of any desired size, and therefore cover the complex-fill shape; however, both these processes lead to variations in the distance between the u-co-ordinate lines. The system therefore combines the offsetting process with translation or dilation (translation, if both are possible), taking the smallest percentage of translation or dilation possible while still creating a patch of stitching large enough to cover the complex-fill shape. The system does not allow curves which are neither translatable nor dilatable, which are very unlikely to be of interest to embroiderers.

The combination of the three processes is accomplished as follows.

Let F(t) be a parametrisation of the original curve. The left and right offsets of F at a distance of h, if they exist, are given by the formulas F(t)+h,n(t) and F(t)−hn(t), where n is the unit normal field to the original curve. There is no guarantee that the resulting curves do not cross over themselves, which would be fatal for stitching. However, it is a mathematical property, of offsets that, for any non-intersecting curve, there is some definite range of values of h for which the equations give consistent, non-intersecting results.

If F is translatable, the system chooses a particular translation vector, which is the median of the unit normal field to F, which we shall denote e. This choice leads to the minimum variation in the distance between F and its translates and hence to stitching with the least possible variation in density. The translates are given by the formula F(t)+h,e, in which his a free parameter which can take any value, and this formula can be used to generate a patch of stitching of any desired size.

The combination patch is generated using the formula F(t)+h((1−a),n(t)+a,e), where h is as above and a is a parameter between 0 and 1 which expresses the relative proportions of offsetting and translation. The case a=0 is pure offsetting while a=1 is pure translation. The case a=0 leads to stitching, with no variation in density but which may not suffice to cover the complex-fill area. The case a=1 leads to stitching which will cover any area, but which suffers from variation in density. The system now chooses the smallest value of a which will still generate enough stitching as to cover the complex-fill area.

If F is not translatable, but is instead dilatable, the system computes the point about which to dilate which results in the least variation in the distance between F and its dilated images, which we call P. This is the centre of the convex set of points with respect to which F is dilatable. The mixed dilation/offset curves are then given by the formula P+(1+a)(F(t)+b,n(t)−P), where b and a are given respectively the smallest and largest values possible while still generating enough stitching to cover the complex-fill shape.

Referring to FIG. 18 a trivial example shows the first curve 180 is translated twice to form two stitch definition curves 181 and 182 surrounding the shape 30.

It should also be appreciated that more than two stitch curves can be used, for instance see FIG. 19, in which there are three stitch definition curves, 190, 191 and 192. Curves 190 and 192 lie on either side of shape 30, but stitch definition curve 191 crosses shape 30 dividing it into two regions 193 and 194. Since the process requires the stitch definition curves to bound the shape, the shape is effectively cut into two shapes which meet along the line 191. The stitch positions can be calculated for each region 194 and 195 separately so that the curvature is different in each region.

It should be appreciated that although the invention has been described with reference to examples which involve transformation between the XY and UT domains, that the invention may be exemplified in other ways, as is indicated in the Summary of the Invention.

When curve fills are used with program split patterns, for instance, the array of circles as in FIG. 16*d,* the circle patterns are slightly distorted. This distortion occurs because the calculation of the stitch points on the edges of the circles is done in the transformed, straight line. UT co-ordinates, and so the circles are necessarily distorted when transformed back into XY, curved, space.

To overcome this problem, after the curved lines of fill are calculated and the inverse transform back to normal XY co-ordinates has been accomplished, then it is possible to recalculate the stitch points as being the intersection points of the inverse transformed curved lines, with the predefined geometry shapes such as an array of circles. It is then possible either to discard the original stitch points, and save only the program split stitch points, or save both. The result is undistorted program split patterns.

In an alternative the split points can be digitized into the area before the initial transformation, so that after the reverse transform they arrive back in the desired positions.

The same logic can be applied to motif fill, so they are not distorted, but follow curved lines of stitching.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A method for generating an embroidery design in a computer aided design system, including the following steps:

(a) specifying an area in the design to be filled with stitching;

(b) specifying a stitch type of embroidery fill stitch to fill the area;

(c) specifying a stitch definition curve;

(d) calculating the positions of stitch points to fill the area, such that the stitch points extend along lines of fill, each of which in order of stitching has a first edge point at one edge of the area, a series of intermediate stitch points and a second edge point at another edge of the area, and such that the intermediate stitch points extend across the lines of fill to form lines of patterns made up of either individual stitch points or groups of stitch points according to the characteristics of the stitch type, and where the lines of fill and the lines of patterns are curved in dependence upon the stitch definition curve but not on the shape of the area to be filled; and (e) recording the positions of the stitch points which extend throughout the area.

2. A method according to claim 1, where the lines of fill are single rows of stitch points.

3. A method according to claim 1, where the lines of patterns are single rows of stitch points.

4. A method according to claim 1, where the specified area is part of a complex shape and the method includes the following additional steps:

(a) calculating the positions of stitch points to fill all the other parts of the complex shape according to the calculating step, and (b) calculating connecting stitches between the parts; where the positions of stitch points are calculated to fill the entire complex shape, and the lines of fill and the lines of patterns extend continuously over all parts of the complex shape.

5. A method according to claim 1, including the step of using a second stitch definition curve.

6. A method according to claim 5, where the second curve is specified independently of the first.

7. A method according to claim 5, where the second curve is generated from the first.

8. A method according to claim 7, where the second curve is offset and either translated or dilated from the first.

9. A method according to claim 5, where the lines of fill and the lines of patterns are curved in dependence upon both the stitch definition curves.

10. A method according to claim 1, where only a single curve is specified, but two stitch definition curves are generated automatically from it for use in the calculation.

11. A method according to claim 1, where more than two stitch definition curves are used, and pairs of adjacent stitch definition curves are used to calculate the positions of stitch points for different parts of the area.

12. A method according to claim 1, including the step of calculating the positions of stitch points to fill an area which is larger than and contains the area to be filled, and then discarding the stitch points which fall outside the area to be filled, so that only the stitches inside the area to be filled are recorded.

13. A method according to claim 1, including the steps of:

(a) calculating the positions of stitch points such that the stitch points extend along straight lines of fill, each of which in order of stitching has a first edge point at one edge of the area, a series of intermediate points and a second edge point at another edge of the area, and such that the intermediate stitch points extend across the lines of fill to form straight lines of patterns made up of single stitch points or groups according to the characteristics of the stitch type; and (b) transforming the positions of stitch points such that the lines of fill and the lines of patterns become curved in dependence upon the stitch definition curve.

14. A method according to claim 13, including the steps of:

(a) initially transforming the outline shape of the area to be filled using a transform that converts the shape made by two stitch definition curves which are joined at either end by straight lines, into a rectangle;

(b) calculating the positions of the stitch points of the transformed outline shape; then, (c) transforming the positions of stitch points using the inverse transform which returns the rectangle back to the shape defined between the two stitch definition curves which are joined at either end by straight lines, and which also returns the transformed outline shape back to the outline shape.

15. A method according to claim 14, including the step of:

initially converting the outline shape of the area into a series of straight line segments before transforming it.

16. A method according to claim 13, where an affine like transform is used.

17. A method according to claim 13, where post processing is employed after the step of transforming the positions of the stitch points, to adjust the relative positions of stitch points within groups.

18. A method according to claim 14, where geometric shapes which will define groups of stitch points are specified with the outline shape of the area to be filled before the initial transform so that the shapes defined by the groups of stitch groups of stitch points are returned unchanged after inverse transformation.

19. A computer aided embroidery design system for generating the positions of stitch points for use by automatic embroidery machines to fill shaped areas in embroidery designs, the system including:

data input means to receive specifications for an area in the design to be filled with stitching, specifications for a stitch type of embroidery fill stitch to fill the area, and specifications for a stitch definition curve;

computation means to calculate the positions of stitch points to fill the area, such that the stitch points extend along lines of fill, each of which in order of stitching has a first edge point at one edge of the area, a series of intermediate stitch points and a second edge point at another edge of the area, and such that the intermediate stitch points extend across the lines of fill to form lines of patterns made up of either individual stitch points or groups of stitch points according to the characteristics of the stitch type, and where the lines of fill and the lines of patterns are curved in dependence upon the stitch definition curve but not on the shape of the area to be filled; and memory means to record the positions of the stitch points which extend throughout the area.

20. A computer aided embroidery design system according to claim 19, where the lines of fill are single rows of stitch points.

21. A computer aided embroidery design system according to claim 19, where the lines of patterns are single rows of stitch points.

22. A computer aided embroidery design system according to claim 19, where the specified area is part of a complex shape and the calculating means also calculates the positions of stitch points to fill all the other parts of the complex shape, and the positions of connecting stitches between the parts; such that the positions of stitch points are calculated to fill the entire complex shape, and the lines of fill and the lines of patterns extend continuously over all parts of the complex shape.

23. A computer aided embroidery design system according to claim 19, where the calculating means uses a second stitch definition curve to calculate the positions of stitch points.

24. A computer aided embroidery design system according to claim 23, where the second curve is specified independently of the first.

25. A computer aided embroidery design system according to claim 23, where the second curve is generated from the first.

26. A computer aided embroidery design system according to claim 25, where the second curve is offset and either translated or dilated from the first.

27. A computer aided embroidery design system according to claim 19, where only a single curve is specified, but two stitch definition curves are generated automatically from it for use in the calculation.

28. A computer aided embroidery design system according to claim 19, where more than two stitch definition curves are used, and pairs of adjacent stitch definition curves are used to calculate the positions of stitch points for different parts of the area.

29. A computer aided embroidery design system according to claim 19, where the calculating means calculates the positions of stitch points to fill an area which is larger than and contains the area to be filled, and then discards the stitch points which fall outside the area to be filled, so that only the stitches inside the area to be filled are recorded in the memory means.

30. A computer aided embroidery design system according to claim 19, where the calculating means calculates the positions of stitch points such that the stitch points extend along straight lines of fill, each of which in order of stitching has a first edge point at one edge of the area, a series of intermediate points and a second edge point at another edge of the area, and such that the intermediate stitch points extend across the lines of fill to form straight lines of patterns made up of single stitch points or groups according to the characteristics of the stitch type; and then transforms the positions of stitch points such that the lines of fill and the lines of patterns become curved in dependence upon the stitch definition curve.

31. A computer aided embroidery design system according to claim 30, where the calculating means initially transforms the outline shape of the area to be filled using a transform that converts the shape made by two stitch definition curves which are joined at either end by straight lines, into a rectangle; then calculates the positions of the stitch points of the transformed outline shape; then, transforms the positions of stitch points using the inverse transform which returns the rectangle back to the shape defined between the two stitch definition curves which are joined at either end by straight lines, and which also returns the transformed outline shape back to the outline shape.

32. A computer aided embroidery design system according to claim 31, where the calculating means initially converts the outline shape of the area into a series of straight line segments before transforming it.

33. A computer aided embroidery design system according to claim 19, where the calculating means uses an affine transform to calculate the positions of stitch points.

34. A series of stitch commands for controlling an automatic embroidery machine to fill a shaped area in an embroidery design, the series including:

a series of sequenced positions of stitch points to fill the area, where the stitch points extend along lines of fill, each of which in order of stitching has a first edge point at one edge of the area, a series of intermediate stitch points and a second edge point at another edge of the area, and such that the intermediate stitch points extend across the lines of fill to form lines of patterns made up of either individual stitch points or groups of stitch points according to the characteristics of the stitch type, and where the lines of fill and the lines of patterns are curved in dependence upon an extrinsically defined stitch definition curve but not on the shape of the area to be filled.

35. A series of stitch commands according to claim 34, where the lines of fill are single rows of stitch points.

36. A series of stitch commands according to claim 34, where the lines of patterns are single rows of stitch points.

37. A series of stitch commands according to claim 34, where the specified area is part of a complex shape and the calculating means also calculates the positions of stitch points to fill all the other parts of the complex shape, and the positions of connecting stitches between the parts; such that the positions of stitch points are calculated to fill the entire complex shape, and the lines of fill and the lines of patterns extend continuously over all parts of the complex shape.

38. A series of stitch commands according to claim 34, where the lines of patterns are curved in dependence upon two extrinsically defined stitch definition curves.

39. A series of stitch commands according to claim 38, where the second curve is specified independently of the first.

40. A series of stitch commands according to claim 38, where the second curve is generated from the first.

41. A series of stitch commands according to claim 40, where the second curve is offset and either translated or dilated from the first.

42. A series of stitch commands according to claim 34, where only a single curve is specified, but two stitch definition curves are generated automatically from it for use in the calculation.

43. A series of stitch commands according to claim 34, where more than two stitch definition curves are used, and pairs of adjacent stitch definition curves are used to calculate the positions of stitch points for different parts of the area.

44. A method according to claim 6, where the lines of fill and the lines of patterns are curved in dependence upon both the stitch definition curves.

45. A method according to claim 7, where the lines of fill and the lines of patterns are curved in dependence upon both the stitch definition curves.

46. A method according to claim 8, where the lines of fill and the lines of patterns are curved in dependence upon both the stitch definition curves.

47. A method according to claim 14, where an affine like transform is used.

48. A method according to claim 15, where an affine like transform is used.

49. A method according to claim 14, where post processing is employed after the step of transforming the positions of the stitch points, to adjust the relative positions of stitch points within groups.

50. A method according to claim 15, where post processing is employed after the step of transforming the positions of the stitch points, to adjust the relative positions of stitch points within groups.

51. A method according to claim 16, where post processing is employed after the step of transforming the positions of the stitch points, to adjust the relative positions of stitch points within groups.

52. A method according to claim 15, where geometric shapes which will define groups of stitch points are specified with the outline shape of the area to be filled before the initial transform so that the shapes defined by the groups of stitch groups of stitch points are returned unchanged after inverse transformation.

53. A method according to claim 16, where geometric shapes which will define groups of stitch points are specified with the outline shape of the area to be filled before the initial transform so that the shapes defined by the groups of stitch groups of stitch points are returned unchanged after inverse transformation.

* * * * *